US006568201B1

(12) United States Patent
Cur et al.

(10) Patent No.: US 6,568,201 B1
(45) Date of Patent: May 27, 2003

(54) HYBRID WINDOW/SPLIT AIR TREATMENT APPLIANCE

(75) Inventors: Nihat O. Cur, St. Joseph, MI (US); Guolian Wu, St. Joseph, MI (US); Douglas David LeClear, Coloma, MI (US); Andrew David Litch, St. Joseph, MI (US); Jim J. Pastryk, Sawyer, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 13 days.

(21) Appl. No.: 09/997,596

(22) Filed: Nov. 29, 2001

(51) Int. Cl.[7] ..... F25D 23/12
(52) U.S. Cl. ..... 62/262; 62/298
(58) Field of Search ..... 62/262, 263, 285, 62/298, 419

(56) References Cited

U.S. PATENT DOCUMENTS

| | | | | | |
|---|---|---|---|---|---|
| 2,320,436 | A | | 6/1943 | Hull | 62/129 |
| 2,486,828 | A | | 11/1949 | Dybvig | 62/129 |
| 2,500,852 | A | | 3/1950 | Money | 62/140 |
| 2,604,763 | A | | 7/1952 | Lipman | 62/129 |
| 2,753,699 | A | | 7/1956 | Gannon | 62/140 |
| 2,760,354 | A | | 8/1956 | Brady et al. | 62/129 |
| 3,448,590 | A | | 6/1969 | Eberhart | 62/262 |
| 3,665,727 | A | | 5/1972 | Mather | 62/262 |
| 3,744,216 | A | * | 7/1973 | Halloran | 55/102 |
| 4,138,859 | A | * | 2/1979 | Pietsch | 62/324 |
| 4,164,852 | A | * | 8/1979 | Anzalone | 62/429 |
| 4,240,264 | A | | 12/1980 | Nakada et al. | 62/125 |
| 5,027,614 | A | | 7/1991 | Mori et al. | 62/262 |
| 5,094,089 | A | | 3/1992 | Lail | 62/429 |
| 5,167,131 | A | | 12/1992 | Karkhanis | 62/262 |
| 5,335,721 | A | | 8/1994 | Wollaber et al. | 165/122 |
| 5,582,025 | A | | 12/1996 | Dubin et al. | 62/262 |
| 5,675,976 | A | | 10/1997 | Tobi et al. | 62/180 |
| 6,098,415 | A | | 8/2000 | Correa | 62/286 |

* cited by examiner

*Primary Examiner*—Melvin Jones
(74) *Attorney, Agent, or Firm*—Robert O. Rice; Stephen Krefman; Thomas J. Roth

(57) ABSTRACT

The invention includes a saddle air conditioner. The saddle air conditioner includes a remote unit having a first channel extending from a back of the remote unit. The saddle air conditioner also includes a local unit having a second channel extending from a back of the local unit. The first channel and the second channel overlap to form a bridge disposed between the remote unit and the local unit.

7 Claims, 22 Drawing Sheets

Fig. 22
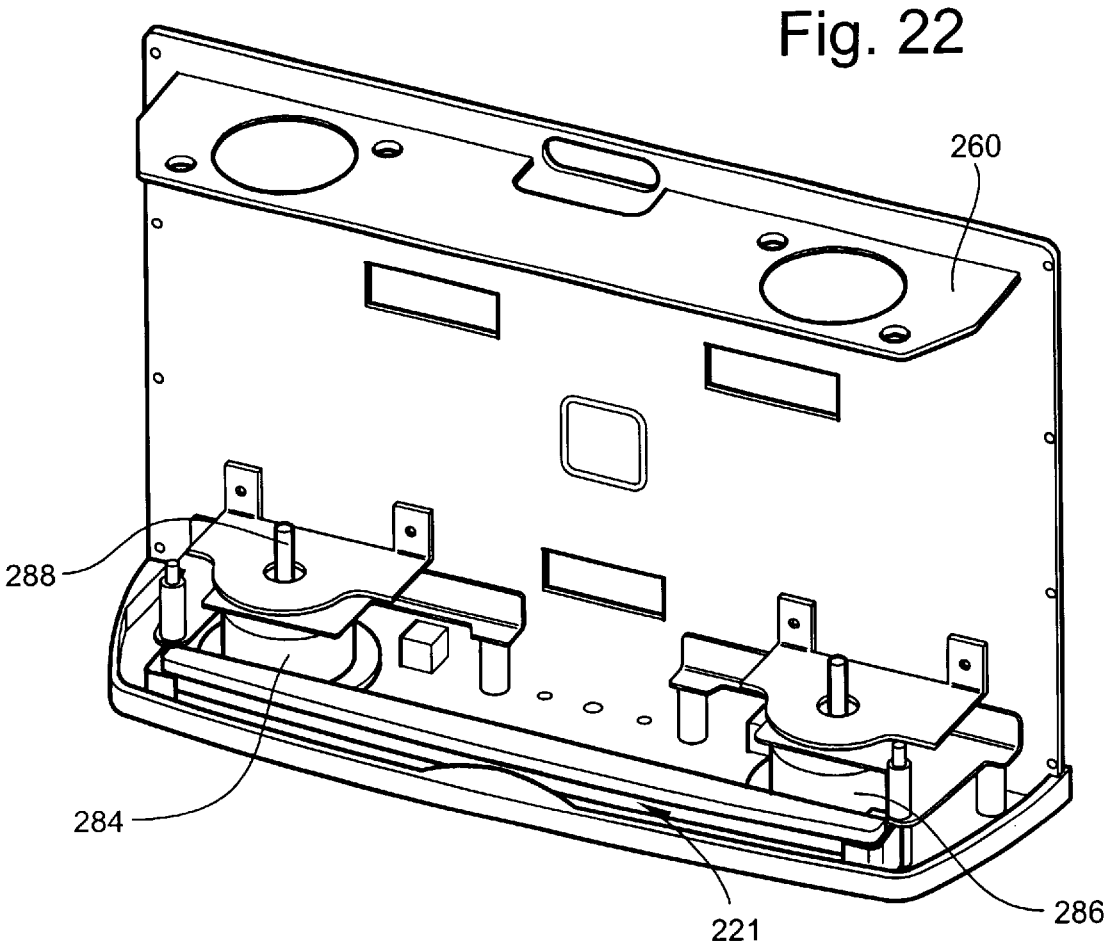
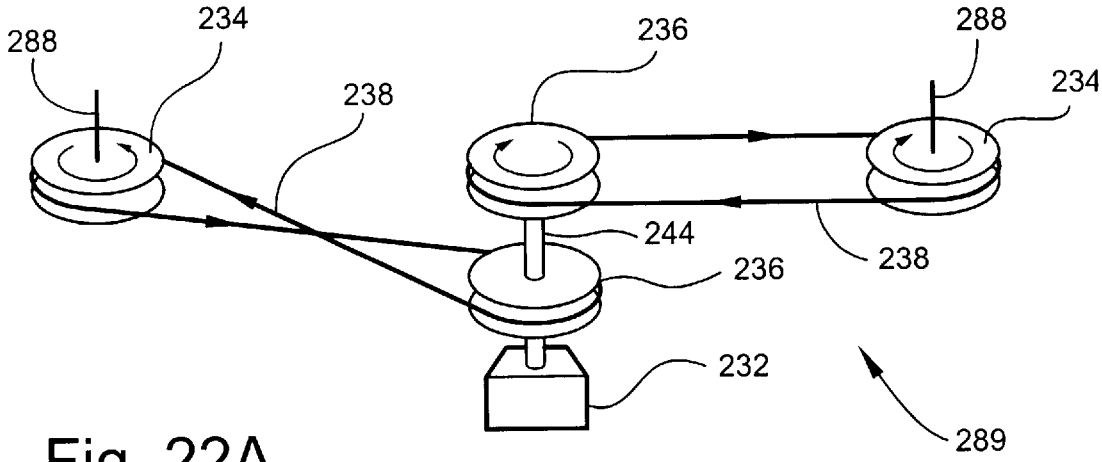
Fig. 22A

HYBRID WINDOW/SPLIT AIR TREATMENT APPLIANCE

The invention includes arrangements to substantially improve customer benefits in window air conditioning and at the same time to reduce assembly and installation requirements and operating noise for a cooling and/or ventilating air treatment appliance.

BACKGROUND OF THE INVENTION

To cool a certain location such as the room of a home, an air cooling unit of an air conditioning system (or "air conditioner") may draw heat from the room into a coolant working fluid. To expel the heat absorbed into the fluid, the air conditioner may route that heated coolant to a location that is remote from the room. There, a heat discharging unit may expel the heat from the coolant into the remote location, typically outdoors.

Conventional room air conditioners may be categorized into window or split air conditioners. A unitary air conditioner may be a unit in which the air cooling unit and the heat discharging outdoor unit are fixed relative to one another to form a single housing. A split air conditioner may be a unit in which the position of the air cooling unit relative to the heat discharging outdoor unit may be varied.

In the area of split air conditioners, assembly, installation, and operating noise are major concerns for customers who purchase air conditioners. One type of split air conditioner is a saddle mount air conditioner. A saddle mount air conditioner may include a low profile service channel disposed between an indoor, air cooling unit and an outdoor, heat discharging unit to permit air, condensate water, coolant, and electricity to pass between each unit. The service channel may be placed on the sill of a window so that the indoor unit and the outdoor unit straddle the sill at locations that are significantly below the horizontal level of the sill.

A problem with conventional window as well as split air conditioners, is they are difficult to assemble and install. For example, service channels of conventional split air conditioners are banded tubes that are pre-charged with working fluid, expensive and limited in their ability to adjust to fit a variety of home constructions. Moreover, heavy, bulky, heat discharging outdoor units of split air conditioners increase the cost of installation. It is desirable that the connecting tube between the heat transfer coils of a split air conditioner be charged with coolant at the factory and that the various auxiliary service tubing be connected at the factory rather than the home of the consumer. However, due to the design of conventional service channels, professional on-site installation is necessary to connect the air, water, coolant, and electrical service lines between the indoor unit and the outdoor unit.

In operation, conventional split air conditioners produce a great amount of noise that finds its way into the inside of a consumer's home. For example, noise from air drawn into the top of the heat discharging unit is propagated through the window glass to the inside of a consumer's home. Also, for window air conditioners in general, an ongoing problem is the noise generated by the components of the air cooling unit located within the consumer's home. Air cooling unit components such as the evaporator fan motor, the speed of the evaporator fan, the arrangement of the evaporator fan, and the condensate removal system each generate noise which is propagated into the room.

It is desirable to have a hybrid room air conditioner that can be configured either as a saddle mount air conditioner which gives customers full access to the window without obstruction or can be assembled as a conventional split or portable air conditioner. It is also desirable to have a unique mechanism that makes the saddle window air conditioner installation simple and easy.

SUMMARY OF THE INVENTION

The invention includes a local unit that may be utilized to provide local cooling and/or air purifying. The local unit may function as the cooling function for a split air conditioner, or a window unit such as a portable air conditioner or a saddle air conditioner. The local unit functions to draw air in a frontal portion and to exit the air out a peripheral portion, thus allowing the unit to be utilized in the same vertical orientation regardless of the configuration of the overall units.

In a preferred embodiment, the local unit is configured with two vertically disposed cross flow fans to draw air from the room, over the evaporator and exhaust the cooled air out through the periphery of the local unit. A similarly configured local unit includes an axial flow or centrifugal fan (herein after "fan") that may be driven directly or indirectly by an electric motor.

In a saddle mount air conditioner configuration, an installation bracket is provided with the saddle air conditioner disposed over the installation bracket, the saddle air conditioner having a remote unit coupled to a local unit with a bridge, and wherein the remote unit includes a back having at least one grill that is adapted to permit air to pass through the back of the remote unit into the remote unit of the saddle air conditioner.

BRIEF DESCRIPTION OF THE DRAWINGS

FIG. 22 is a perspective view of the local unit with the shroud removed to reveal a first motor and a second motor;

FIG. 22A schematically illustrates a blower wheel motor system;

DETAILED DESCRIPTION OF THE INVENTION

Figure 1:
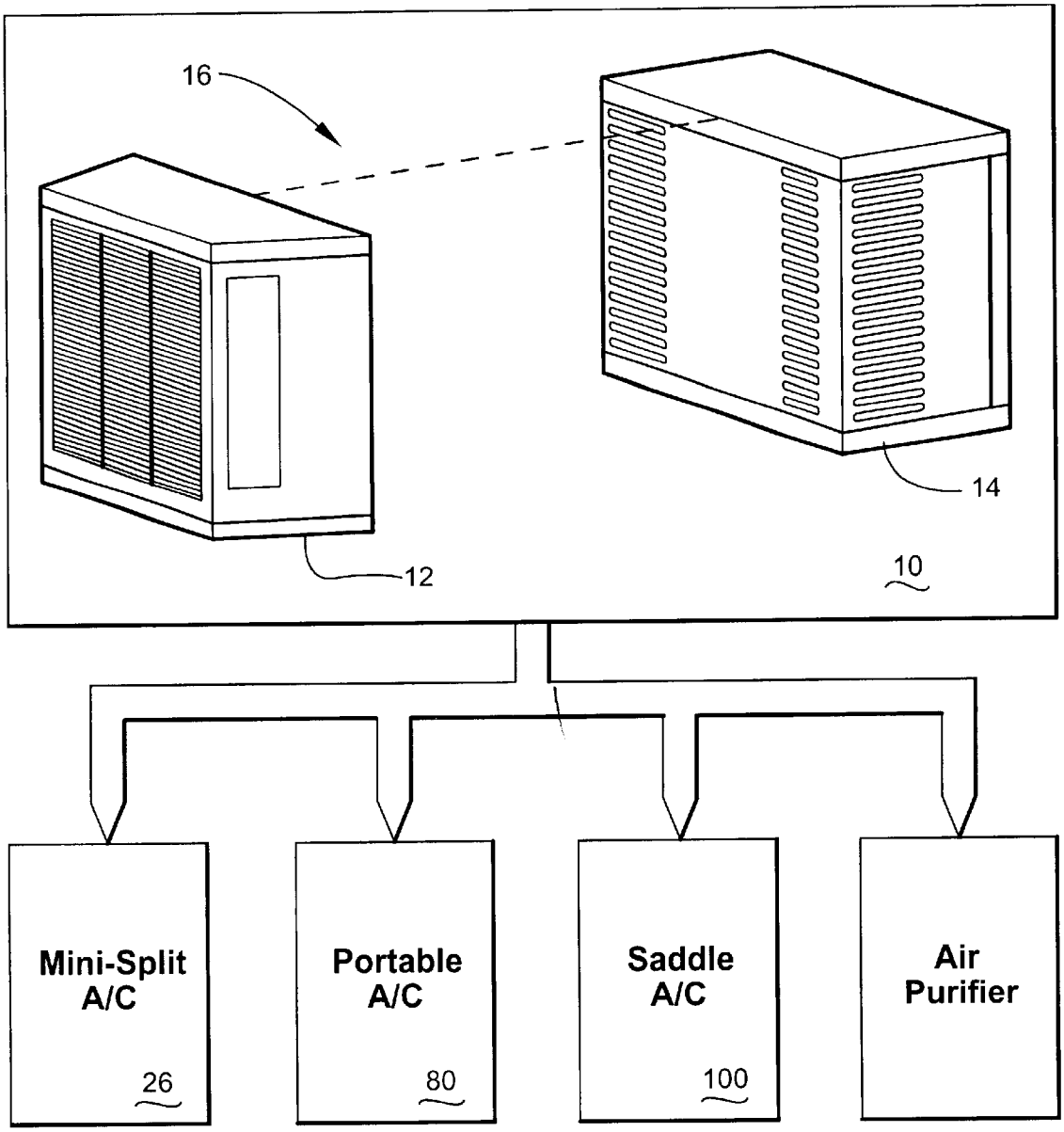
FIG. 1 illustrates split air conditioner incorporating principles of the invention.

FIG. 1 illustrates a split air conditioner embodying principles of the present invention. Included with the air conditioner 10 may be a local unit 12 and a remote unit 14. The local unit 12 may include an evaporator system that both absorbs heat from the surrounding environment into a working fluid and passes that heated fluid to the remote unit 14. The remote unit 14 may include a condenser system that may expel heat from the fluid to aid in cooling the fluid, whereupon the fluid may be recirculated to the local unit 12.

Coupled between the local unit 12 and the remote unit 14 may be a supply system 16. The supply system 16 may include an adjustable structure that aids in routing tubing, such as air, condensate water, coolant, and electricity tubing, between the local unit 12 and the remote unit 14. Under this arrangement, the air conditioner 10 may be viewed as a split air conditioner. Here, the adjustibility of the supply system 16 may permit a user to position the local unit 12 in any one of a number of orientations with respect to the remote unit 14. As schematically illustrated in FIG. 1, the air conditioner 10 may include a mini-split air conditioner 26 of FIG. 2, a portable air conditioner 80 of FIG. 3, a saddle air conditioner 100 of FIG. 4 and FIG. 5, or the local unit may be utilized as an air purifier as exemplified in FIG. 15.

Figure 2:
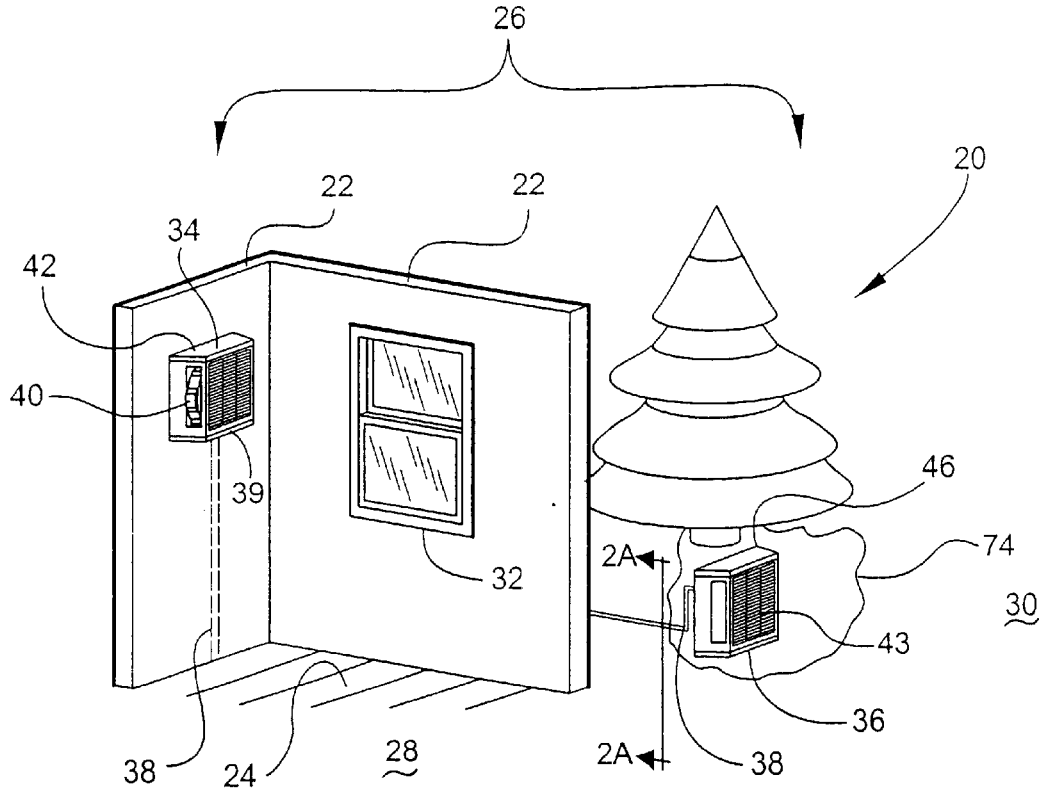
FIG. 2 illustrates an air conditioner system.

FIG. 2 illustrates an air conditioner system 20. Included with the air conditioner system 20 may be a wall or walls 22, a surface 24, and the mini-split air conditioner 26. The walls 22 may meet with a ceiling (not shown) and the surface 24 so as to define an area (here, an indoors area 28) that may be distinguished from an outdoor area 30. The indoor area 28 may be an area within a building enclosed by the walls 22 and the surface and a ceiling. The walls 22 may include a window 32 so that the indoor area 28 need not be completely isolated from the outdoor area 30 area. Moreover, the outdoor area 30 may include any location that is remote from the indoor area 28, even where a structure does not exist to physically separate the two areas.

The mini-split air conditioner 26 may include a local unit 34, a remote unit 36, and a supply cable 38. In the view shown in FIG. 2, the local unit 34 may include a front grill 39, a first louver 40, and a second louver 92 (FIG. 15), each disposed within or as part of a housing 42. The front grill 39 may be any network of fixed or movable slats that define a mesh of openings to pass air. The first louver 40 may be any framed opening fitted with fixed or movable slats to pass air.

In the view shown in FIG. 2, the remote unit 36 may include a front grill 43, a first louver 41 (FIG. 6), and a second louver 44 (FIG. 28), each disposed within or as part of a housing 46. The front grill 43 and the second louver 44 may be similar to the front grill 39 and first louver 40, respectively. Moreover, the slats of the front grill 43 and the second louver 44 may be arranged to shed rain so that the housing 46 works to repel water without allowing rain to penetrate within the housing 46.

Figure 2A:
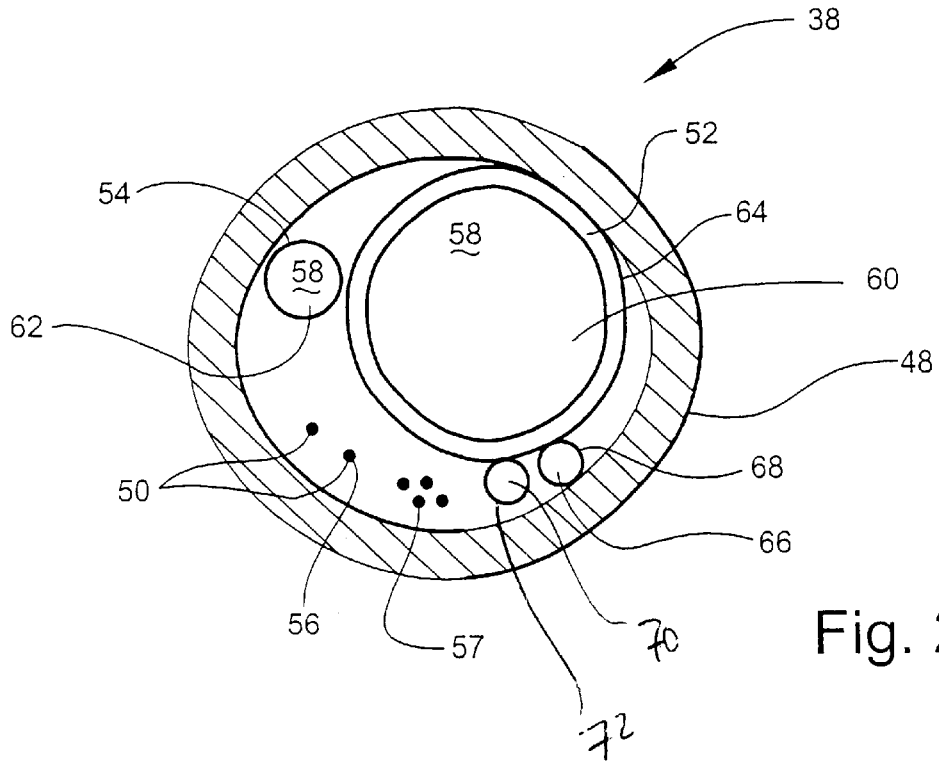
FIG. 2A is a sectional view of a supply cable taken generally along line 2A—2A of FIG. 2.

FIG. 2A is a sectional view of a supply cable 38 taken generally along line 2A—2A of FIG. 2. The supply cable 38 may be viewed as an umbilical cord that works towards providing auxiliary services between the local unit 34 and the remote unit 36. The supply cable 38 may include a sleeve 48. The sleeve 48 may be any tubular construction designed to cover other parts. Alternatively, the sleeve 48 may be a series of ties that bundle other parts together. Moreover, the sleeve 48 may include insulation disposed about its interior or exterior surface.

The sleeve 48 may be flexible or rigid through structural design, selection of material, or a combination of the two. For example, the sleeve 48 may be made from corrugated tubing surrounded by a polyethylene non-chlorinated jacket. The material of the sleeve 48 may include at least one of plastic, rubber, cloth, metal, polyvinyl chloride (PVC), and wood. When made of a rigid material, the sleeve 48 may include joints, mating pieces, and elongated pieces of varying lengths to permit a user to position the local unit 34 in any one of a number of orientations with respect to the remote unit 36. In the embodiment shown in FIG. 2A, the sleeve 48 is made of copper.

The supply cable 38 may also include power lines 50, a suction line 52, and an expansion line 54. The power lines 50, the suction line 52, and the expansion line 54 may be disposed within the sleeve 48. The power lines 50 may include any cable used to distribute electricity 56. The suction line 52 and the expansion line 54 may be a system of elongated tubes that may be used to pass a coolant 58 between the local unit 34 and the remote unit 36. The coolant 58 may be any agent that produces cooling, especially a working fluid (liquid or gas) that relays heat through circulation. Examples of the coolant 58 of FIG. 2A include air, ammonia, water, carbon dioxide, the fluorinated hydrocarbon Freon®, and the high-pressure coolant chlorodifluoromethane R-22.

When disposed within the suction line 52, the coolant 58 may be referred to as a chilled coolant 60 since the suction line 52 may transmit a relatively low temperature coolant 58 from the local unit 34 to the remote unit 36. When disposed within the expansion line 54, the coolant 58 may be referred to as a heated coolant 62 since the expansion line 54 may transmit a relatively high temperature coolant 58 from the remote unit 36 to the local unit 34. To maintain the temperature of the chilled coolant 60, the suction line 52 further may include insulation 64 disposed about an exterior of suction line 52.

In operation, the chilled coolant 60 may pass through evaporator coils 220 (FIG. 15) within the local unit 34 as air is passed over the evaporator coils 220. A side effect of the chilled coolant 60 passing through the local unit 34 as air is passed over the evaporator coils 220 is that atmospheric moisture from the passing air may condense on evaporator coils 220 as a condensate 66. The condensate 66 may collect in a pan 221 (FIG. 15) at a base 218 of the local unit 34. It is desirable to remove the condensate 66 from the pan 221 so that the condensate 66 does not spill out of the local unit 34.

Figure 24:
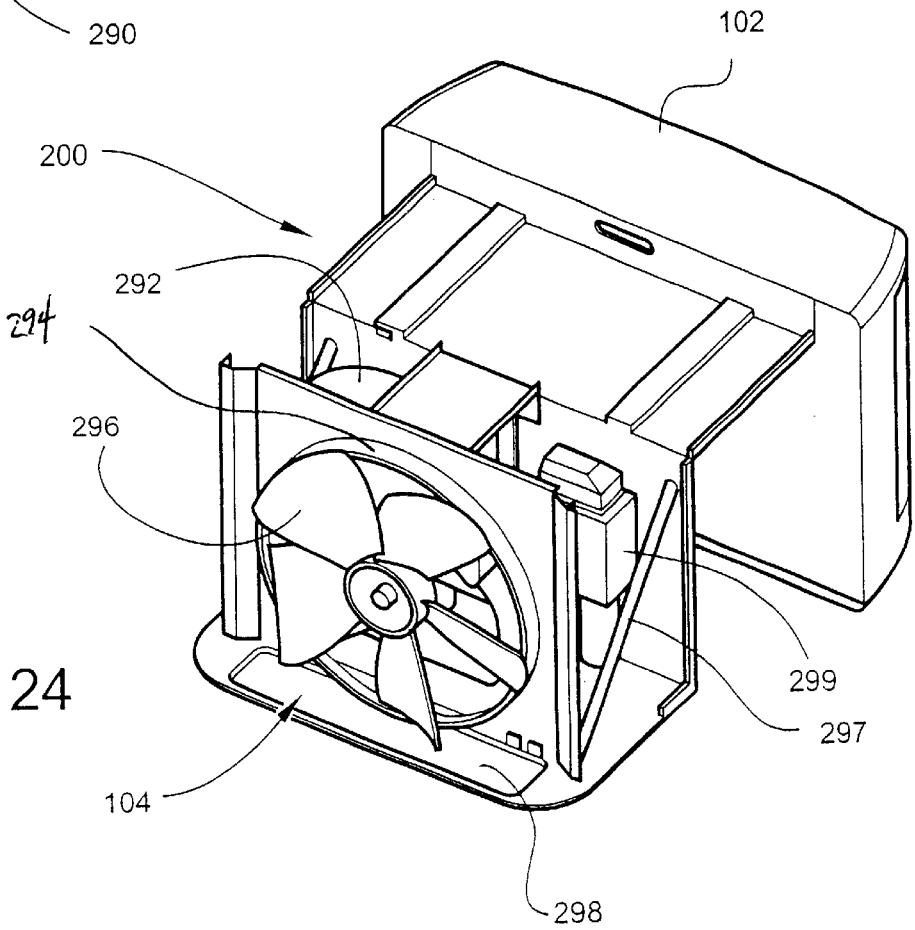
FIG. 24 is a detailed view of the remote unit with condenser tubes removed.

To aid in removing the condensate 66, the supply cable 38 of FIG. 2A may further include a condensate line 68. The condensate 66 may be moved through the condensate line 68 by a condensate removal pump 299 (FIG. 24). When the condensate removal pump 299 is located in the remote unit 36 and is an air pump that pumps air 70, the supply cable 38 may also include an air tube 72. The air tube 72 may include a filter to purify the air 70 prior to the air 70 entering the indoor area 28.

An advantage of the mini-split air conditioner 26 is that the local unit 34 may be installed at a location that is remote from the window 32. Moreover, the remote unit 36 may be installed at a location that is remote from the window 32 so as to minimize or completely eliminate the introduction of noise into the indoor area 28 from the remote unit 36. Further, the mini-split air conditioner 26 may include two or more of the local units 34 where each local unit 34 may be distributed within the indoor area 28 as well as coupled to the remote unit 36.

The mini-split air conditioner 26 of FIG. 2 may be installed as follows. The remote unit 36 may be placed on a surface 74 in the outdoor area 30. The supply cable 38 may be coupled to the remote unit 36 and routed through the wall 22 to a location within the indoor area 28. Part of the supply cable 38 is shown in phantom in FIG. 2 to indicate that the supply cable 38 is routed on the outdoor area 30 side of the wall 22. The supply cable 38 may also be routed on the indoor area 28 side of wall 22. The supply cable 38 may be coupled to the local unit 34. The local unit 34 may then be fixed to a position within the indoor area 28, such as on the wall 22.

Figure 3:
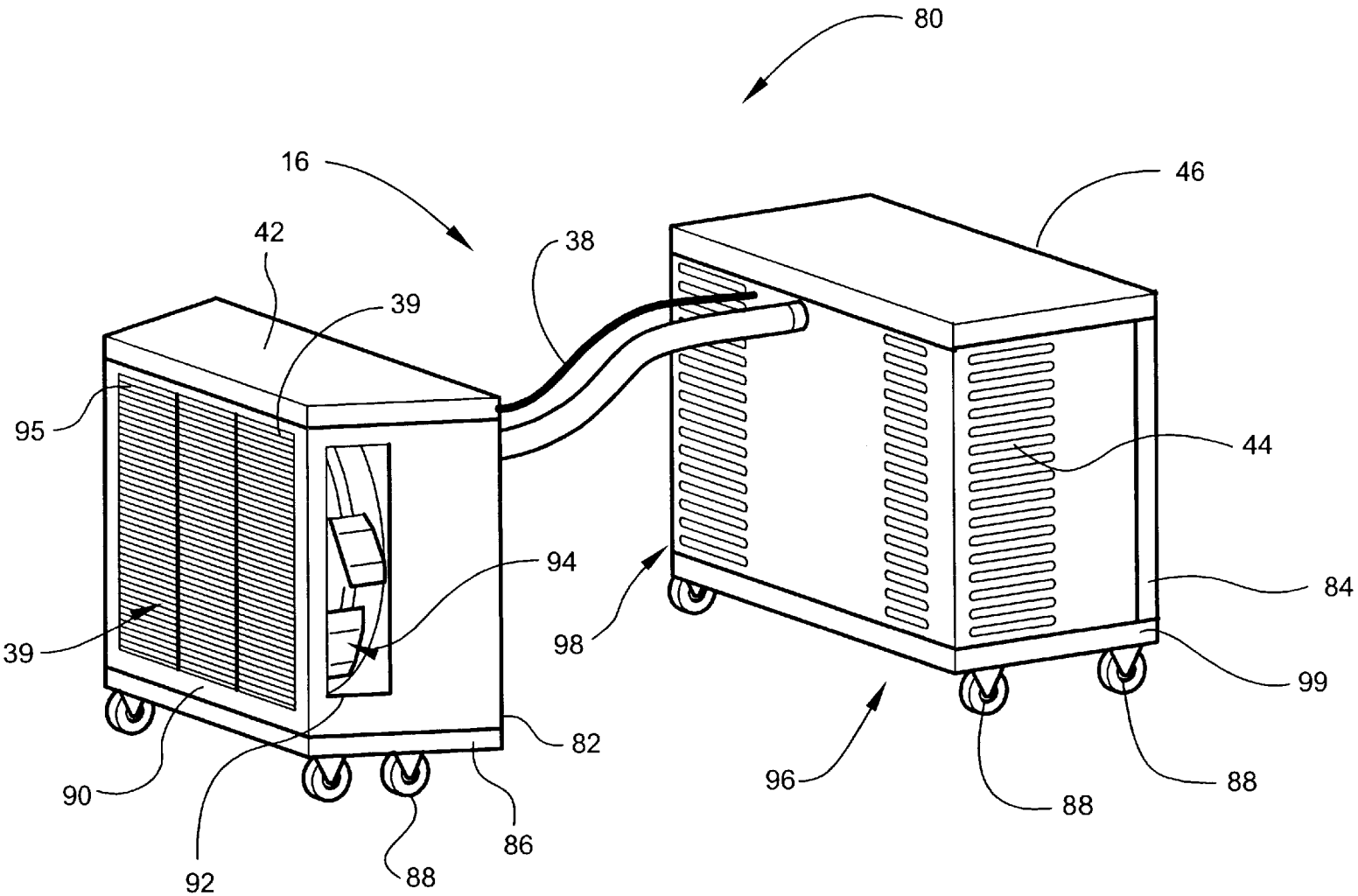
FIG. 3 illustrates a perspective view of a portable air conditioner.

FIG. 3 illustrates a perspective view of the portable air conditioner 80.

Included with the portable air conditioner 80 may be the supply cable 38 disposed between a local unit 82 and a remote unit 84.

The local unit 82 may include the front grill 39, the housing 42, a platform 86, casters 88, a plate 90, the first louver 40 (FIG. 2), a second louver 92 (FIG. 15), and a fan 94. While an axial fan is illustrated at 94, those skilled in the art recognize that many other type fans could be utilized, and that reference in this description to an axial fan is for illustrative purposes only. As in the split air conditioner 26 of FIG. 2, the front grill 39 may be disposed in or as part of the housing 42. The front grill 39 may include finger handles 95 to aid in removing the front grill 39 from and installing the front grill 39 into the housing 42.

The housing 42 may be disposed on the platform 86. Alternatively, the platform 86 may be part of the housing 42. In general, the platform 86 may include any horizontal surface raised above the level of an adjacent area. In the embodiment shown, the platform 86 may be raised above the level of an adjacent area by the casters 88. Each caster 88 may include a small wheel on a swivel. The swivel may be attached under a platform to make it easier to move a platform and to transport a unit of the portable air conditioner 80. The plate 90 may be used to display a company logo.

Figure 15:
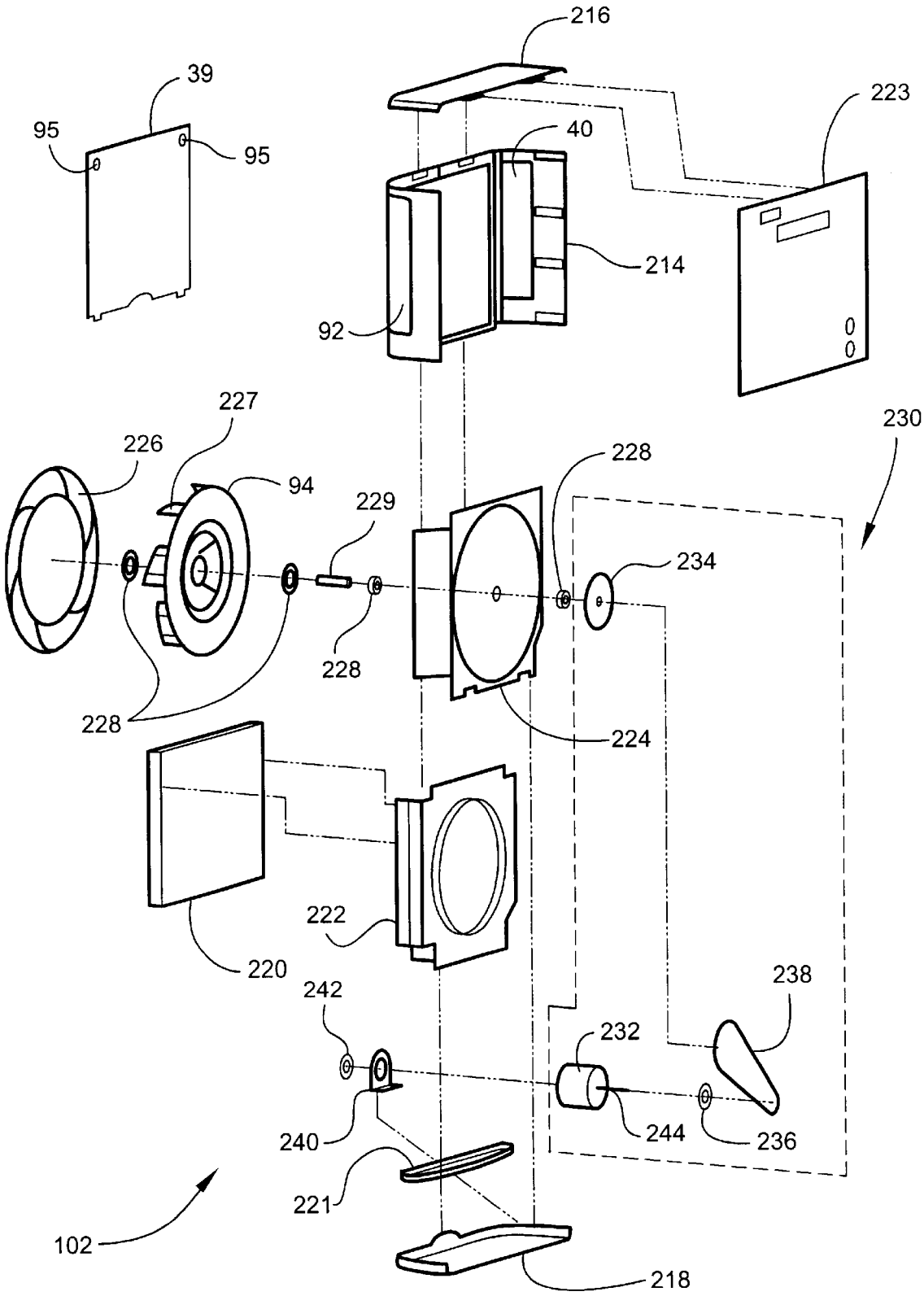
FIG. 15 is an exploded view of the local unit of FIG. 14.

In the view shown in FIG. 3, the second louver 92 has been removed to reveal the fan 94. The fan 94 may define an axis of rotation that is parallel to a horizontal flow of air drawn by the fan 94. The fan 94 may aid in circulating air into the local unit 82 through the front grill 39 and out of the local unit 38 through the first set of louvers 40 and the second set of louvers 92 (FIG. 15).

The remote unit 84 of FIG. 3 may include a first set of louvers 41 (FIG. 28), a second set of louvers 44, the housing 46, a first back grill 96, a second back grill 98, a platform 99, and the casters 88. The second louver 44 may be coupled to the housing 46 as shown. Moreover, each of the first back grill 96 and the second back grill 98 may be disposed in the housing 46 on the supply cable 38 side of the remote unit 84 to receive air that is external to the remote unit 84 (as discussed in connection with FIG. 27 and FIG. 28). The housing 46 may be disposed on the platform 99. Alternatively, the platform 99 may be part of the housing 46. In general, the platform 99 may include any horizontal surface raised above the level of an adjacent area. In the embodiment shown, the platform 99 may be raised above the level of an adjacent area by the casters 88.

Figure 4:
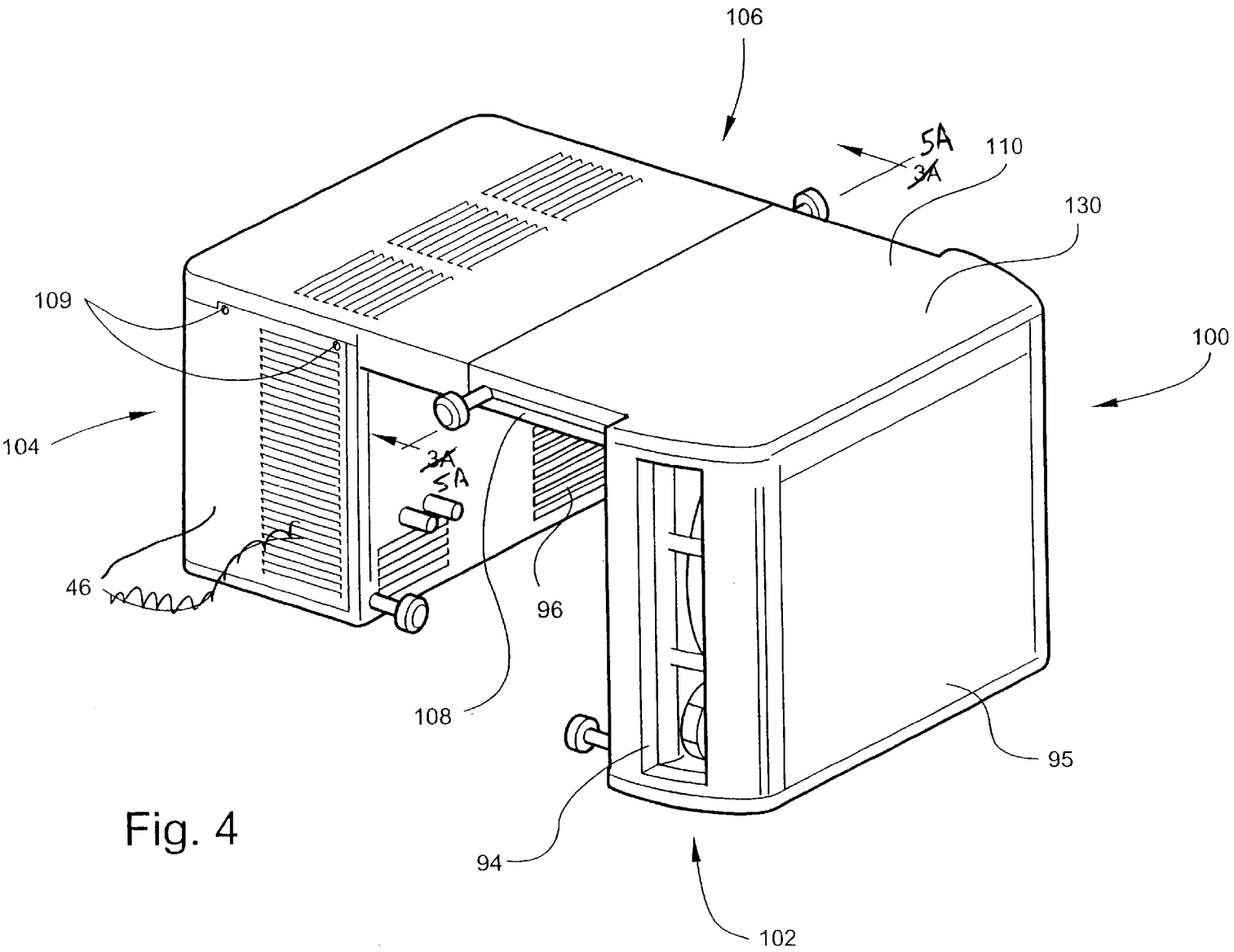
FIG. 4 illustrates a perspective view of a saddle air conditioner.

FIG. 4 illustrates a perspective view of the saddle air conditioner 100. The saddle air conditioner 100 may include a local unit 102, a remote unit 104, and a bridge 106. The local unit 102 and the remote unit 104 may be similar to the local unit 34 and the remote unit 36 of FIG. 2, respectively, or to the local unit 82 and the remote unit 84 of FIG. 3, respectively.

The bridge 106 may include a low-profile, rectangular shaped channel. Moreover, the bridge 106 may be coupled between the local unit 102 and the remote unit 104 to provide a structure from which the local unit 102 and the remote unit 104 may hang. The bridge 106 may also serve to channel between the local unit 102 and the remote unit 104 at least one of the following: the power lines 50 (FIG. 2A), the suction line 52, the expansion line 54, the condensate line 68, and the air tube 72.

The bridge 106 of FIG. 4 may include a plurality of telescoping beams, such as two telescoping beams. In the embodiment shown in FIG. 4, the bridge 106 includes a first beam 108 and a second beam 110. The first beam 108 and the second beam 110 each may be a telescoping beam.

Figure 5:
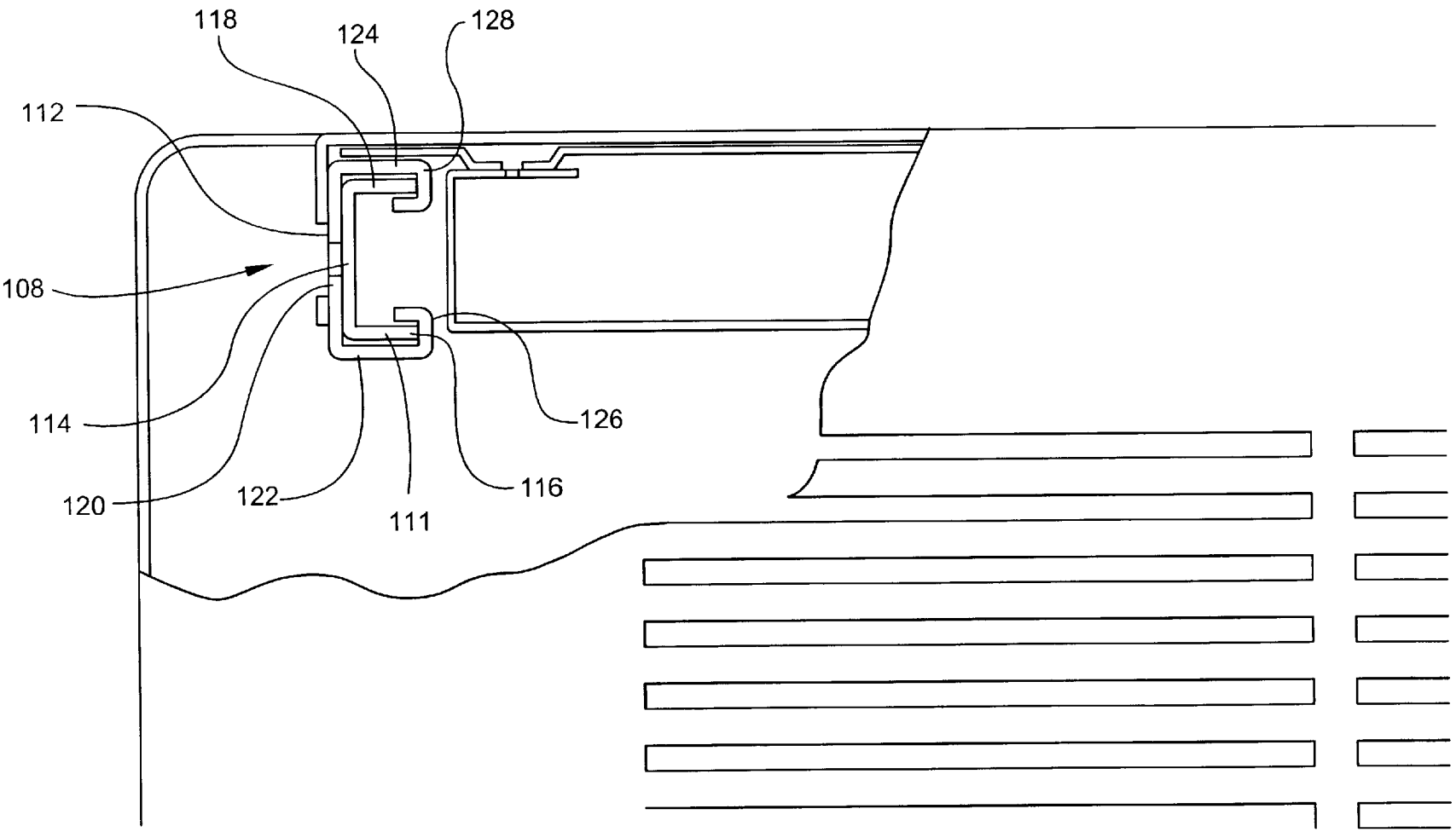
FIG. 5 is a perspective view of a beam taken generally along line 5A—5A of FIG. 4.

FIG. 5 is a perspective view of the first beam 108 taken along of line 5A—5A of FIG. 4. The first beam 108 may include a first or interior channel 111 and a second or exterior channel 112. The interior channel 111 may include a base 114 coupled between a first side 116 and a second side 118. The exterior channel 112 may include a base 120 coupled between first side 122 and second side 124. The first side 122 of the exterior channel 112 may be coupled to a first L-shaped bracket 126 whereas the second side 124 may be coupled to a second L-shaped bracket 128, such that the second L-shaped bracket 128 may oppose the first L-shaped bracket 126.

The interior channel 111 and the exterior channel 112 each may be made from galvanized steel. In one embodiment, the material thickness of at least one of the interior channel 111 and the exterior channel 112 is less than or equal to one eighth of an inch thick. In another embodiment, the exterior channel 112 is a 1-⅝ inch wide metal framing channel P-4100.

In assembly, a first end of the interior channel 111 may be fixed to the remote unit 104, such as by welding or bolting, such as with bolts 109 (FIG. 4). A first end of the exterior channel 112 may be fixed to the local unit 102 in a similar manner. A second end of the exterior channel 112 may be disposed to abut the remote unit 104 when the remote and local units are disposed in the closest disposition end (not shown).

Included with the bridge 106 may be a cover 130. The cover 130 may include two overlapping sections that may be adapted to move relative to one another over a predetermined distance without separating from one another.

Figure 6:
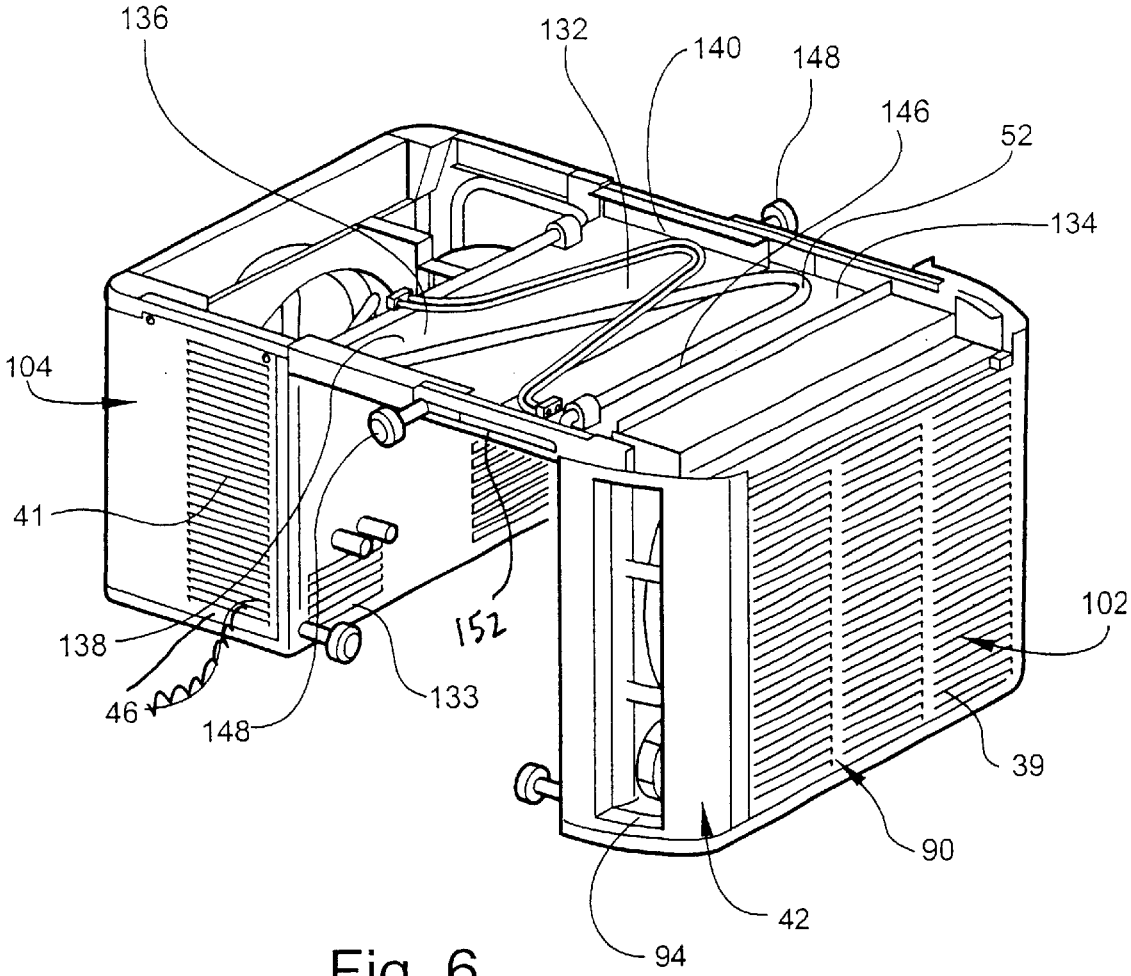
FIG. 6 illustrates a perspective view of the saddle air conditioner with a cover removed.

FIG. 6 illustrates a perspective view of the saddle air conditioner 100 with the cover 130 removed. As shown, the bridge 106 may further include an interior tray 132 and an exterior tray 134. The interior tray 132 and the exterior tray 134 each may be viewed as a channel.

The interior tray 132 may be coupled to the housing 46 of the remote unit 104. For example, the interior tray 132 may be coupled to the back and base of the housing 46 to form a Z-shaped structure 133 similar to remote Z-bracket 200 of FIG. 14.

The exterior tray 134 of the local unit 102 similarly may form a part of a Z-shaped structure with respect to the housing 42.

The interior tray 132 and the exterior tray 134 may have a structure that permits the interior tray 132 to be disposed within the exterior tray 134. In the embodiment shown, the interior tray 132 may include a base 136 disposed between a first lip 138 and a second lip 140. The exterior tray 134 may include a base 146 disposed between the exterior channel of beam 108 and 110. The base 146 may define a length that may equal a length of the housing 42.

In one embodiment, the remote unit 104 may be about eighty pounds (thirty six kilograms) and the local unit 102 may be about thirty pounds (14 kilograms).

To assemble the local unit 102 to the remote unit 104, the interior channels 111 are inserted into channels 112 and secured by hand screw fasteners 148 in slots 152 in channels 112. The power lines 50 and line 52, 54 maybe connected and the cover 130 placed on the local unit 102 and remote unit 104 to form the saddle conditioner 100. Thus the units 102 and 104 may be disposed a predetermined distance from each other, the predetermined distance may be the width of a windowsill.

Figure 7:
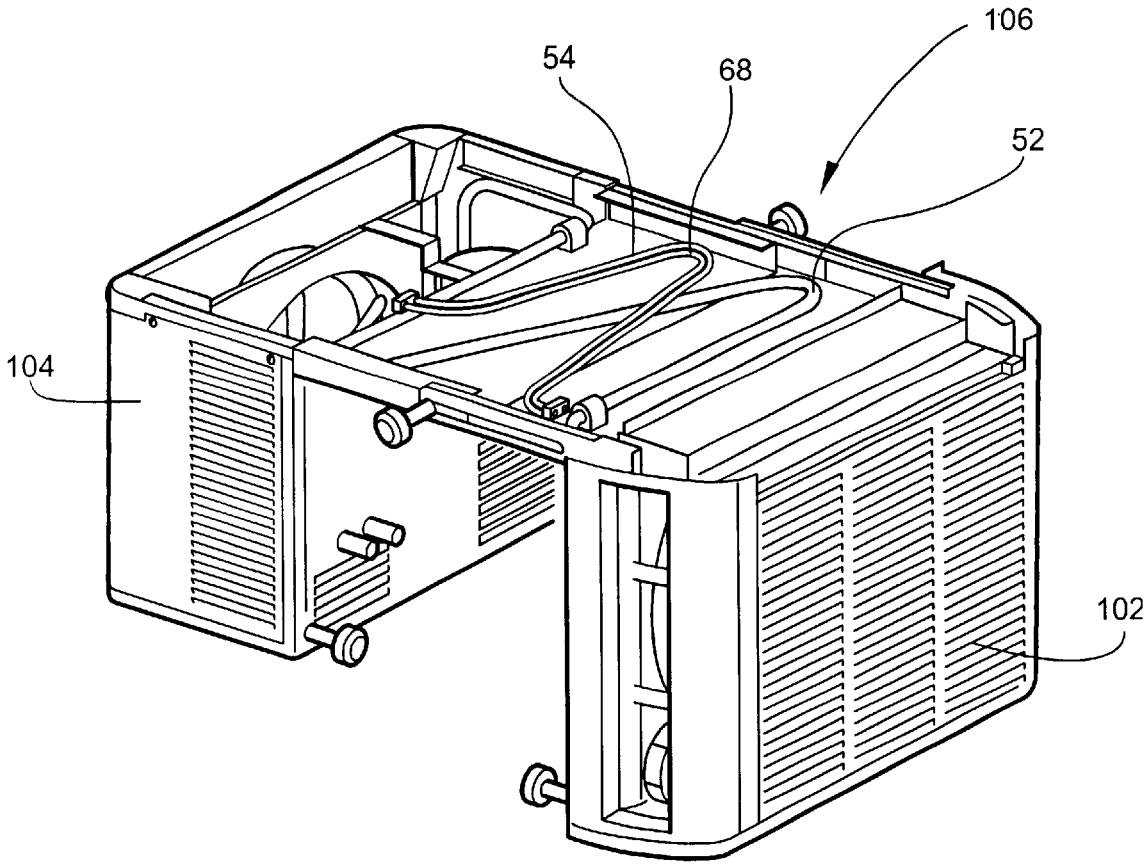
FIG. 7 illustrates flexible tubing disposed within the bridge.

FIG. 7 illustrates flexible tubing disposed within the bridge 106. Flexible tubing (or pipeline) may include tubing that can be installed in single long runs without the necessity of regular joints either to extend the length of the tubing or to change directions. In one embodiment, flexible tubing may be disposed between the local unit 102 and the remote unit 104 to provide passageways for electricity 56 (FIG. 2A), the chilled coolant 60, the heated coolant 62, the condensate 66, and the air 70. For example, disposed within the bridge 106 may be at least one of the power lines 50, the suction line 52, the expansion line 54, and the condensate line 68. Each may employ flexible tubing which may be accessible by removing the cover 130 (FIG. 5) from the interior tray 132 and exterior tray 134 as shown in FIG. 7.

Figure 8:
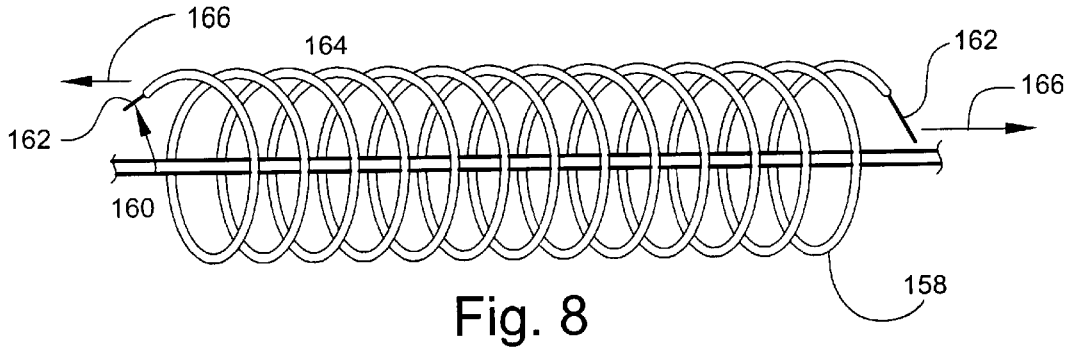
FIG. 8 illustrates helical tubing.
Figure 9:
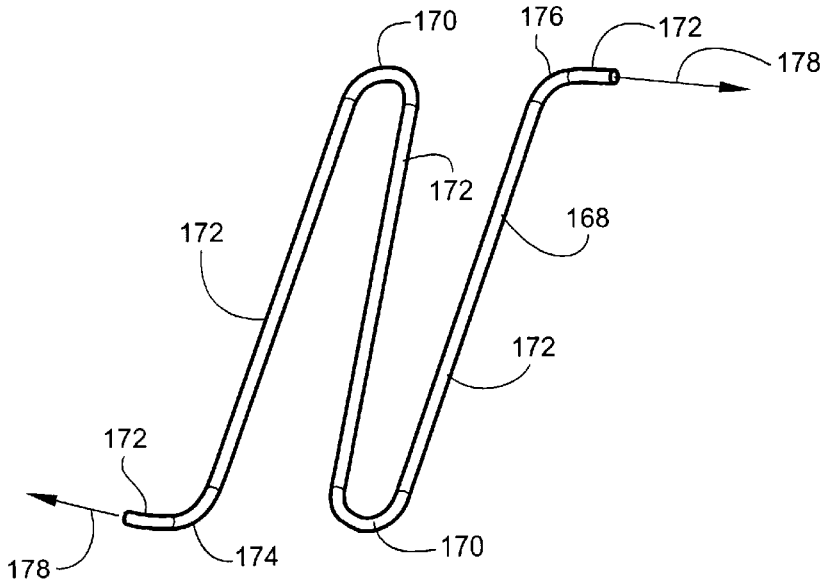
FIG. 9 illustrates serpentine tubing.
Figure 10:
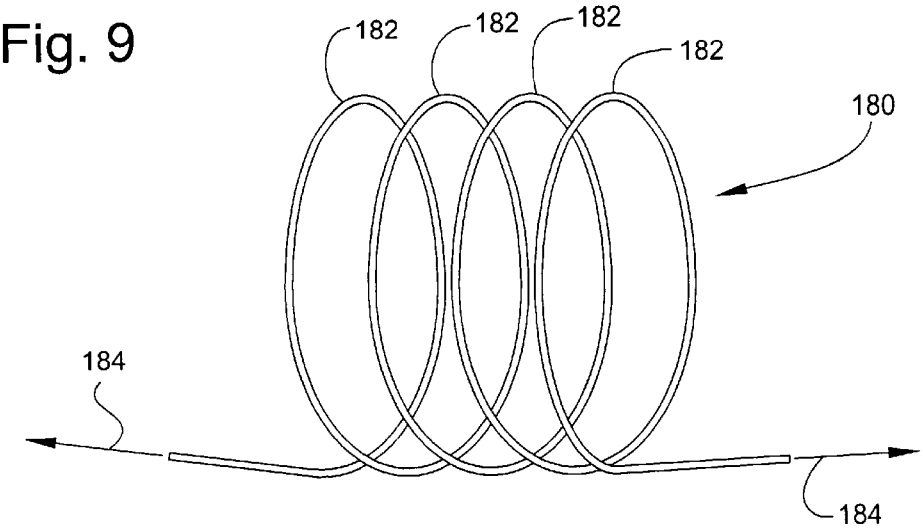
FIG. 10 illustrates roll tubing.

FIG. 8 illustrates a helical tubing 158. FIG. 9 illustrates a serpentine tubing 168. FIG. 10 illustrates a roll tubing 180. The helical tubing 158, the serpentine tubing 168, and the roll tubing 180 each may be viewed as a type of flexible tubing. Here, each of the helical tubing 158, the serpentine tubing 168, and the roll tubing 180 may be flexible through structural design or a combination of structural design and selection of material. The material of one of the helical tubing 158, the serpentine tubing 168, and the roll tubing 180 may include plastic, rubber, cloth, metal, polyvinyl chloride (PVC), or wood.

The helical tubing 158 of FIG. 8 may be defined by a three-dimensional curve disposed about an axis 160 so that an angle of the curve to a plane disposed perpendicular to the axis 160 is constant. The distance between the axis 160 and the center 162 of the helical tubing 158 may define a radius 164. The radius 164 may be constant or may vary over a length of the helical tubing 158. In one embodiment, the radius 164 ranges from 0.1 to 0.4 inches. In another embodiment, the radius 164 equals 0.25 inches. The helical tubing 158 may extend in the directions of arrows 166 and may include connectors (not shown) at each end.

The serpentine tubing 168 of FIG. 9 may be defined by a two-dimensional curve that follows a sinuous path. The serpentine tubing 168 may include curved pieces 170, straight sections 172, a first coupler curve 174, and a second coupler curve 176. The curved pieces 170 may be hollow tubes bent towards a C-Shape or U-Shape. The straight sections 172, the first coupler curve 174, and the second coupler curve 176 each may be hollow tubes. Moreover, the first coupler curve 174 and the second coupler curve 176 may be bent at an angle of greater than ninety degrees.

The straight sections 172 may couple the curved pieces 170, the first coupler curve 174, and the second coupler curve 176 to one another. The serpentine tubing 168 may extend in the direction of arrows 178. Moreover, the serpentine tubing 168 may include connectors (not shown) at each end and may be made of rigid material.

Based on the various standard window constructions around the world, it is important that the distance between the first coupler curve 174 and the second coupler curve 176 be adapted to expand or contract over a length of about ten inches (twenty five centimeters). However, the distance between each curved piece 170 is limited to the length of the window 32. To provide the desired flexibility over the width of the bridge 106 (FIG. 7) when serpentine tubing 168 is made from rigid material and used in the bridge 106, the serpentine tubing 168 includes at least two curved pieces 170 as shown in FIG. 9. A construction of the serpentine tubing 168 having a single curved piece 170 would be insufficient to permit expansion and contraction over a ten-inch length.

The roll tubing 180 of FIG. 10 may be defined by windings 182. Each winding 182 may define a perpendicular axis that is parallel to the axes of the other windings 182. Each of the windings 182 may overlap an adjacent winding 182 or be overlapped by an adjacent winding 182. In one embodiment, an overlap of adjacent windings 188 may define a height that extends perpendicularly from the view of FIG. 10 to a range of 0.25 to 0.80 inches. The roll tubing 180 may extend in the direction of arrows 184. Moreover, the roll tubing 180 may include connectors (not shown) at each end and may be made of rigid material. To provide the desired flexibility over the width of the bridge 106 when the roll tubing 180 is made from rigid material, the roll tubing 180 includes at least two windings 182 as shown in FIG. 9.

The helical tubing 158 provides good flexing action whereas the serpentine tubing 168 and the roll tubing 180 provide low profile advantages. At least one of the helical tubing 158, the serpentine tubing 168, and the roll tubing 180 may be used for at least one of the power lines 50 (FIG. 2A), the suction line 52, the expansion line 54, the condensate line 68, and the air tube 72. In one embodiment, the serpentine tubing 168 may be made from copper and used for the suction line 52. This may be seen in FIG. 7. Moreover, the roll tubing 180 may be used for the expansion line 54, where the expansion line 54 may be long and slender with a very small internal diameter, much like a capillary vessel. The helical tubing 158 may be used for the air tube 72. Further, a meandering line may be used for the power lines 50 and the condensate line 68 as seen in FIG. 7.

Figure 11:
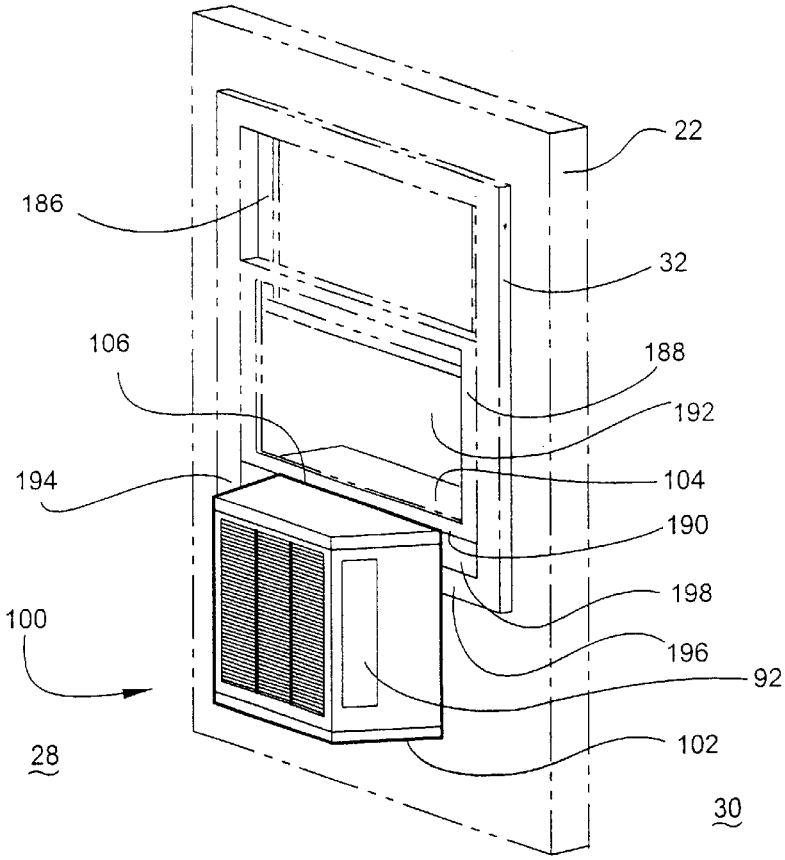
FIG. 11 illustrates an installation of the saddle air conditioner.

FIG. 11 illustrates an installation of the saddle air conditioner 100. The saddle air conditioner 100 may be installed into the wall 22 having the window 32 to give a consumer full access to the window 32. Giving a consumer full access to the window 32 eliminates the need to remove the saddle air conditioner 100 from the window 32 during winter. This also permits a consumer to place decorations such as flowerpots and pictures on the top of the local unit 102 without concern that the decorations will need to be relocated during winter.

The window 32 may include an upper sash 186 and a lower sash 188. The lower sash 188 may include a sash frame 190 and a glass 192 disposed within the sash frame 190. The window 32 further may include a windowsill 194 having a bottom rail 196.

To install the saddle air conditioner 100 into the window 32, the lower sash 188 may be raised towards the position of the upper sash 186. From a position within the indoor area 28, the saddle air conditioner 100 may be raised and extended so that the remote unit 104 may be positioned within the outdoor area 30 and the local unit may be positioned within the indoor area 28. The saddle air conditioner 100 may then be lowered so that the bridge 106 contacts the bottom rail 196 of the windowsill 194.

Figure 12:
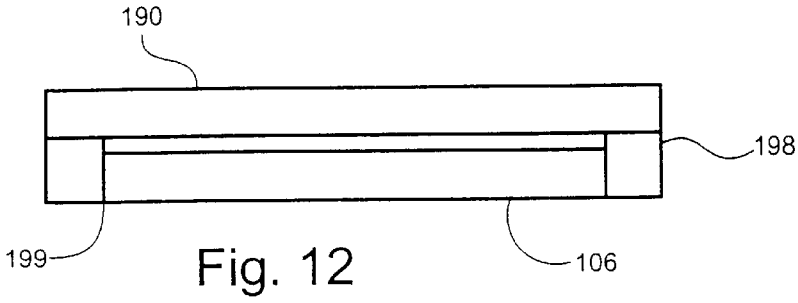
FIG. 12 illustrates a gap filler having one cutout.
Figure 13:
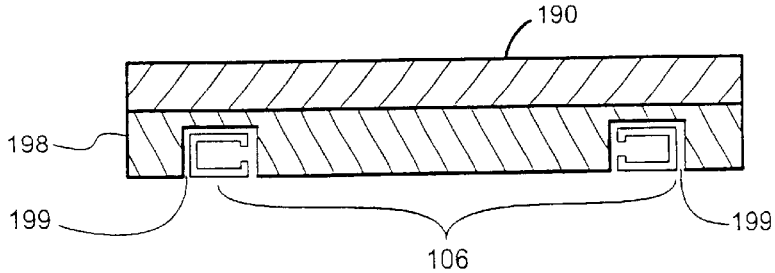
FIG. 13 illustrates the gap filler having two cutouts.

To provide a seal between the indoor area 28 and the outdoor area 30, the saddle air conditioner 100 may further include a gap filler 198. The gap filler 198 may be a preformed foam or insulating material. Moreover, the gap filler 198 may include one or more cutouts 199 and may be made of an insulating material, such as urethane foam. FIG. 12 illustrates the gap filler 198 having one cutout 199. The arrangement of the gap filler 198 in FIG. 12 may be used for the saddle air conditioner 100 as seen in FIG. 5. FIG. 13 illustrates the gap filler 198 having two cutouts 199. The arrangement of the gap filler 198 of FIG. 13 may be used for the saddle air conditioner 100 of FIG. 4. The gap filler 198 may be disposed over the bridge 106 and the bottom rail 196. With the gap filler 198 in position, the sash frame 190 of the lower sash 188 may be closed onto the gap filler 198.

Alternatively, the sash frame 190 may be designed with two notches that fit around the exterior of the beam 106 and the first beam 108 of FIG. 4. This may maximize the direct contact between the lower sash 188 and the bottom rail 196 and further provide access to the window 32 to a consumer.

Figure 14:
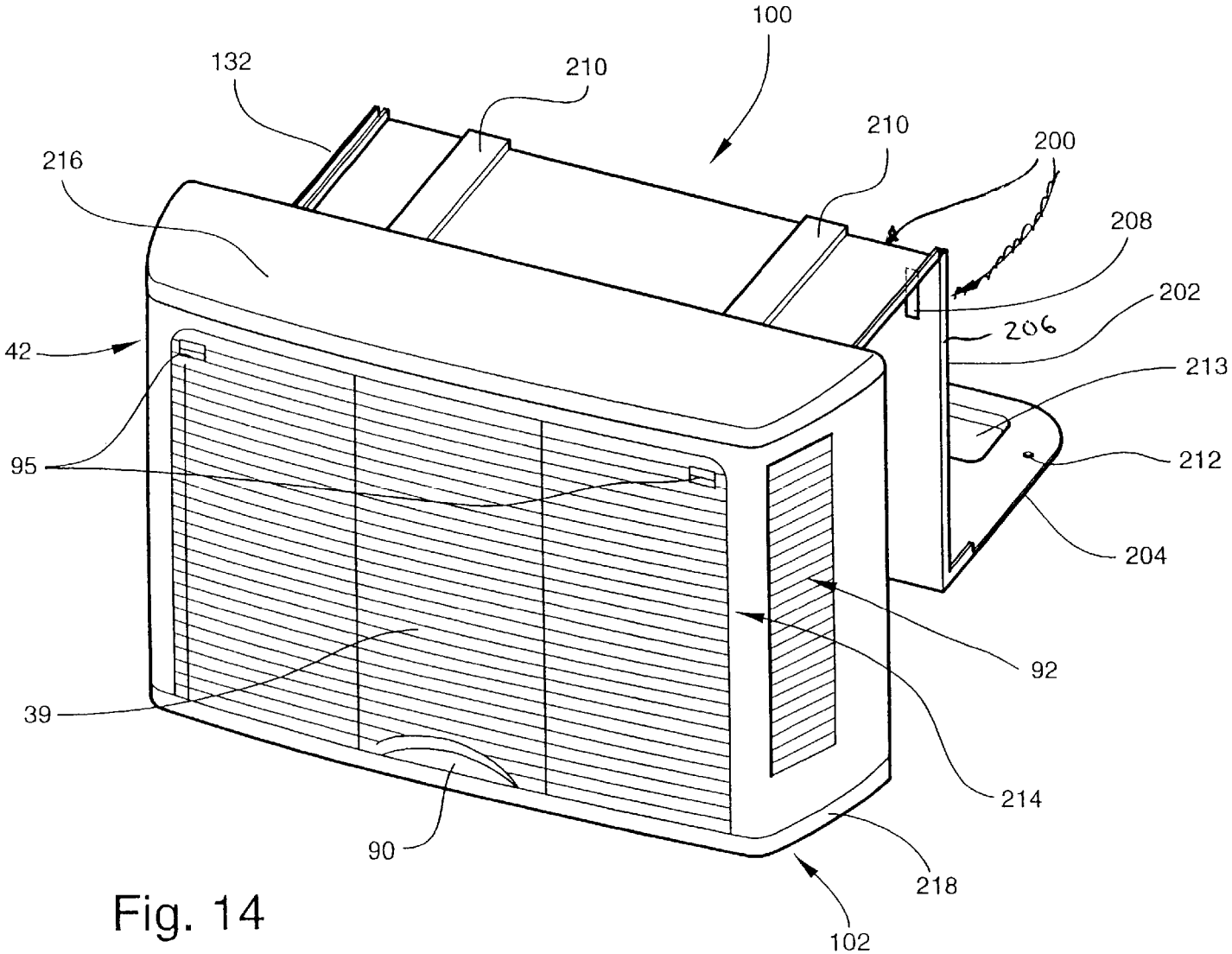
FIG. 14 illustrates the saddle air conditioner with an exterior tray and the majority of the remote unit removed to reveal a Z-bracket.

As noted above, the interior tray 132 may be coupled to a back and base of the housing 46 to form a Z-shaped structure. FIG. 14 illustrates the saddle air conditioner 100 with the exterior tray 134 and the majority of the remote unit 104 removed to reveal a Z-bracket 200. The Z-bracket 200 may include a back 202 coupled between the interior tray 132 and a base 204 to form a Z-shaped structure. A single sheet of metal may define the interior tray 132, the back 202, and the base 204.

The back 202 may form a punch out 208. The interior tray 132 may include indents 210. The base 204 may include a support hole 212 and a sump 213. The tab 206 and the support hole 212 may aid in supporting parts disposed on the base 204 (such as a brace 297 of FIG. 24). The indents 210 may provide a raised portion into which an installation bracket 300 (FIG. 25) may be disposed. The sump 213 may serve as a repository for the waste condensate 66 as discussed more fully in connection with FIG. 24.

As seen in FIG. 14, the housing 42 of the local unit 102 may include a center housing 214 disposed between a top housing 216 and a base 218. The front grill 39 may be located within the center housing 214 by employing the finger handles 95.

FIG. 15 is an exploded view of the local unit 102 of FIG. 14. As seen in FIG. 15, residing behind the front grill 39 may be the evaporator coils 220. As noted above, atmospheric moisture from air passing over the evaporator coils 220 may condense on the evaporator coils 220 as the condensate 66 (FIG. 2A). To collect the condensate 66, the local unit 102 of FIG. 15 may further include a trough or pan 221. The pan 221 may be fixed to the base 218 at a location that is below the evaporator coils 220. The pan 221 may include an angled bottom that meets at a midpoint of the pan 221. The local unit 102 may further include a back plate 223 to complete the housing 42.

The evaporator coils 220 may be connected to the expansion line 54 (FIG. 2A) through an expansion device or valve (not shown). In the process of the high pressure coolant 62 passing though the expansion device, the high pressure coolant 62 may go through a pressure drop to become the cold, low-pressure chilled coolant 60 in a vapor/liquid phase. In this regard, the evaporator coils 220 of the local unit 102 may be a set of coils that allow the chilled coolant 60 to absorb heat and cool down the air inside the indoor area 28. Thus, the local unit 102 may be referred to as an evaporator unit where the evaporator coils 220 may serve as part of an evaporator heat exchanger system. In one embodiment, the evaporator coils 220 are flat coils.

Behind the evaporator coils 220 may be an orifice 222. Behind the orifice 222 may be a fan deflector 224. Circumscribed by the fan deflector 224 may be a fan ring 226 disposed against the fan blades 227 of the fan 94. Air inside the indoor area 28 may be drawn through the evaporator coils 220 by the fan 94 so as to be cooled. The bearings 228 may permit a shaft 229 to rotate the fan 94 without the shaft 229 rotating the fan deflector 224. The orifice 222 may aid in directing this now cooled air into the fan 94. The fan 94 may centrifugally expel the cooled air into the fan deflector 224 as directed by the fan blades 227. The fan deflector 224 may then direct the cooled air through the first louver 40 and the second louver 92 of the center housing 214 into the indoor area 28.

A motor may drive the fan 94. Conventionally, a motor is located directly behind a fan in a saddle air conditioner to provide a direct drive of a fan. Moreover, conventional high-speed operations may occur at 1100 revolutions per minute (RPM). To reduce the level of noise introduced into the indoor area 28 from the operations of fan 94, the fan 94 may be driven at low speeds, such as 500 to 700 RPM. Although it is possible to accomplish this with a low speed, direct drive motor, low speed motors are relatively more expensive when high efficiency is needed.

To drive the fan 94 at low speeds, the local unit 103 of the saddle air conditioner 100 may further include a fan motor system 230. The fan motor system 230 may be simply an efficient low speed motor. Also, system 230 may be, as illustrated as an indirect drive, pulley operated, fan speed reduction system. The fan motor system 230 may include a motor 232, a first pulley wheel 234, a second pulley wheel 236, and a pulley belt 238. The motor 232 may be coupled to the base 218 through a motor bracket 240. Between the motor bracket 240 and the motor 232 may be a cushion ring 242. The cushion ring 242 may work to absorb vibrations of the motor 232 and to prevent these vibrations from transmitting to the base 218 of housing 42.

Figure 16:
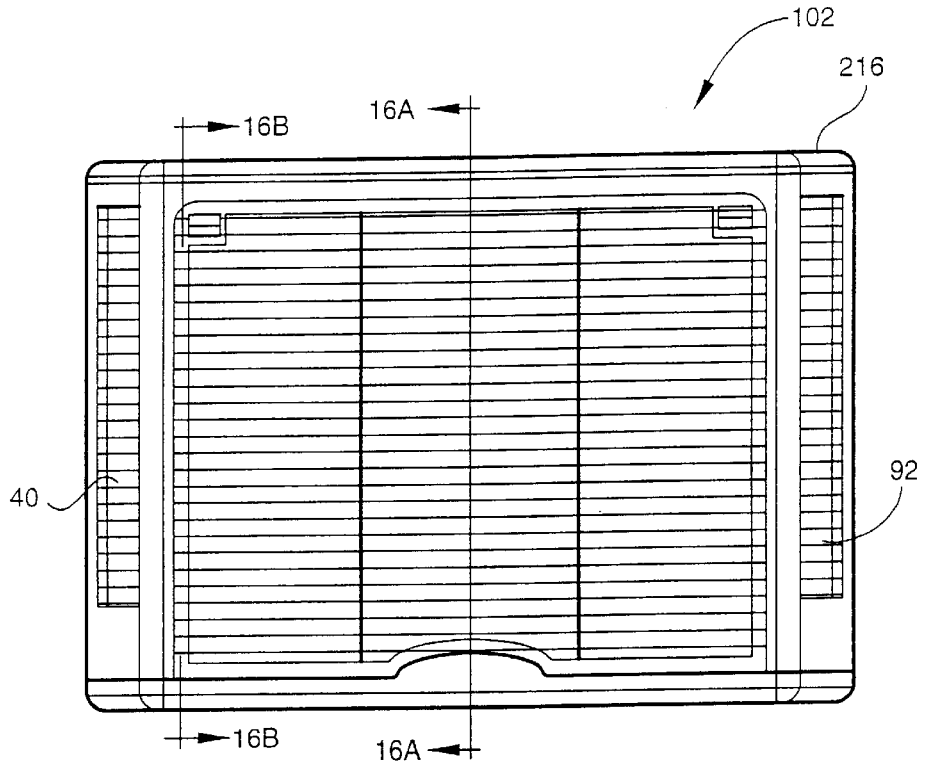
FIG. 16 is a front view of the local unit.
Figure 16B:
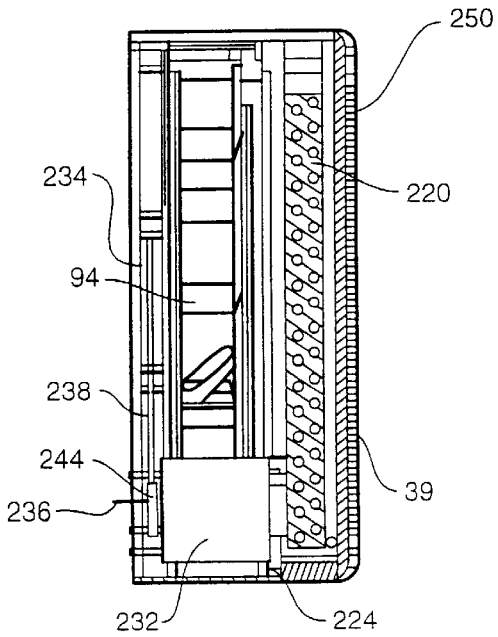
FIG. 16B is a sectional view of the local unit taken generally along line 16B—16B of FIG. 16.
Figure 16A:
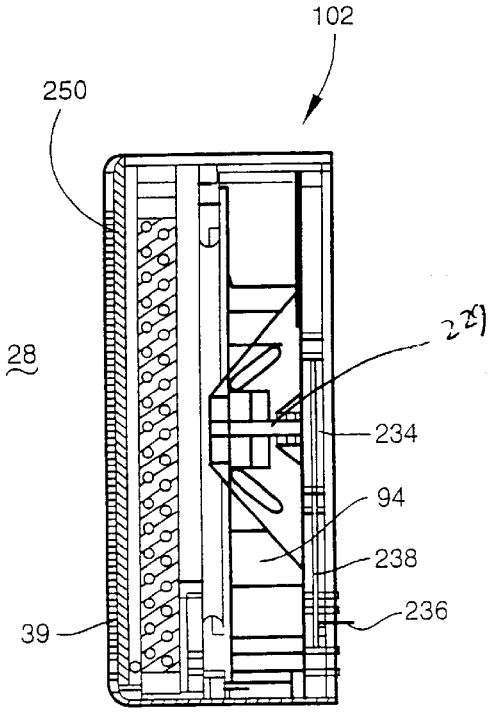
FIG. 16A is a sectional view of the local unit taken generally along line 16A—16A of FIG. 16.
Figure 17:
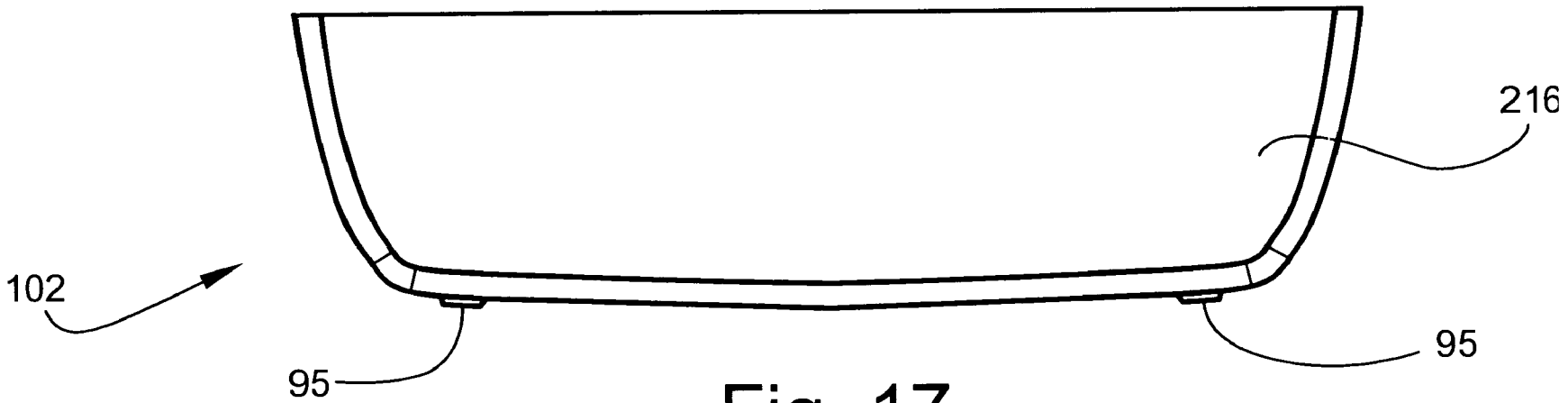
FIG. 17 is a top view of the local unit.

FIG. 16 is a front view of the local unit 102. FIG. 16A is a sectional view of the local unit 102 taken along line 16A—16A of FIG. 16. FIG. 16B is a sectional view of the local unit 102 taken along line 16B—16B of FIG. 16. FIG. 17 is a top view of the local unit 102. FIG. 16A and FIG. 16B each illustrate aspects of the fan motor system 230.

As seen in FIG. 16A, the shaft 229 may be disposed in the center of the first pulley wheel 234. From FIG. 16B, it may be seen that a shaft 244 of the motor 232 may be disposed in the center of the second pulley wheel 236. The shaft 229 may define an axis that is parallel to, but remote from, an axis of the shaft 244. The independence of the motor 232 from the remote unit 104 works to allow the motor 232 to handle a greater pressure drop, such as may be caused by the use of a filter. In this embodiment, the local unit 102 may include a filter 250 disposed between the front grill 39 and the evaporator coils 220 to aid in purifying the air from the indoor area 28. The filter 250 may be a high performance air filter that adds an air-purifying feature to the cooling capabilities of the saddle air conditioner 100.

Figure 18:
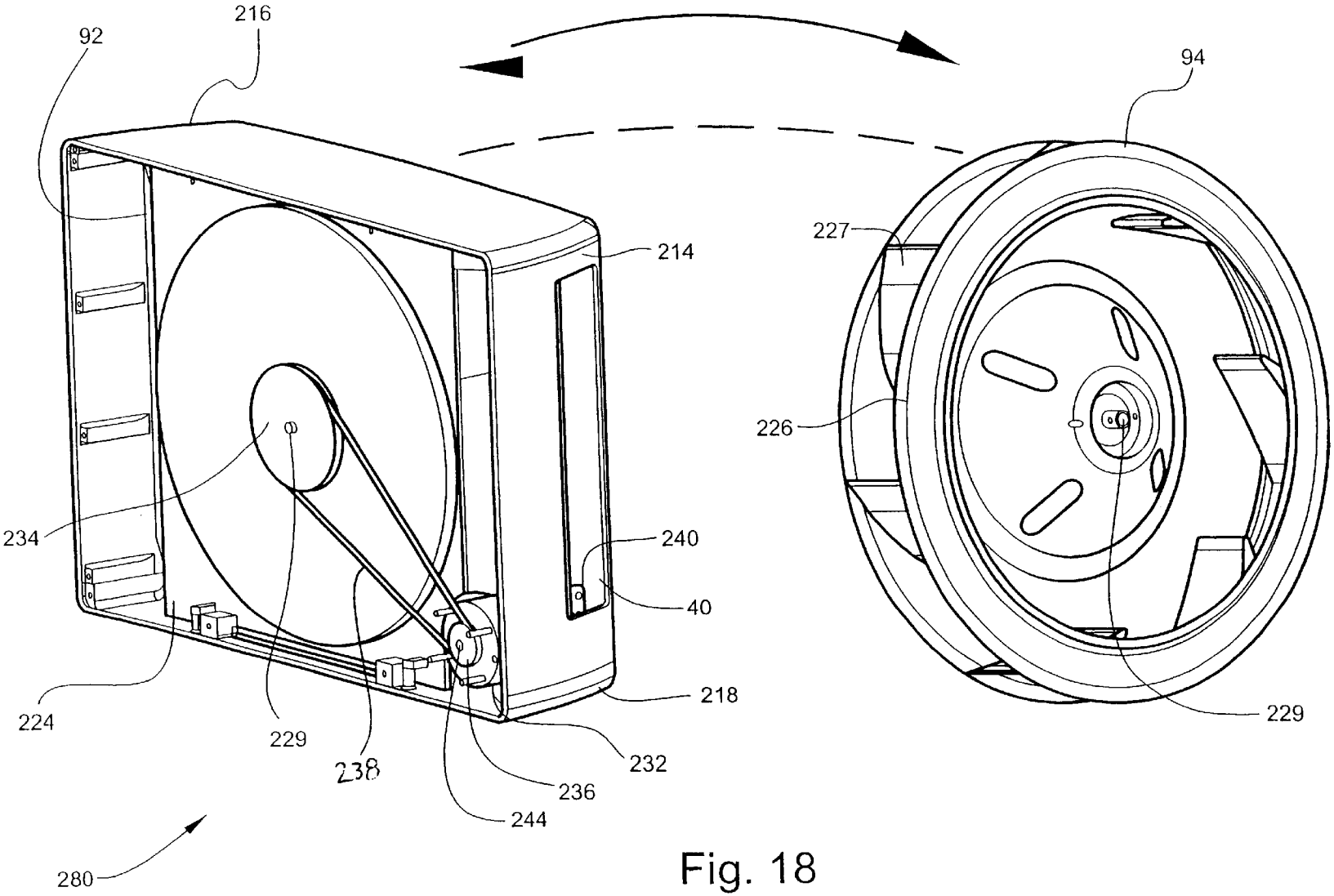
FIG. 18 illustrates an exploded, perspective view of a fan motor system.

FIG. 18 illustrates an exploded perspective view of the fan motor system 230. As seen, the first pulley wheel 234 may be coupled to the shaft 229 and the second pulley wheel 236 may be coupled to the shaft 244 of the motor 232. The pulley belt 238 may be coupled between the first pulley wheel 234 and the second pulley wheel 236. The pulley belt 238 may be any power-transmitting device adapted to rotate over a path that leads back onto itself. The first pulley wheel 234 may define a diameter that is larger than a diameter of the second pulley wheel 236.

The motor 232 may include a plurality of poles where the number of poles is less than six. For example, the motor 232 may be a four pole permanent split capacitor fan motor having an operating speed of around 1500 revolutions per minute (RPMs) at an efficiency of 50 to 90 percent. Moreover, the motor 232 may be a two-pole motor. The motor 232 may also be a C-frame motor having an operating speed in the range of 2400 to 3500 RPMs at a maximum efficiency of 20–30%. The first pulley wheel 234 and the second pulley wheel 236 may define a diameter relationship that reduces the operating speed of the motor 232 at shaft 229 to a range of 500 to 700 RPMs at an efficiency of higher than 85%. In one embodiment, the ratio of the diameter of the first pulley wheel 234 to the diameter of the second pulley wheel 236 may be in the range of about 3:2 to 7:1 with an efficiency of 95% to 98%.

A low power transmission loss between the shaft 244 and the shaft 229 may work to lower the cost of the local unit 102 while maintaining the desired fan output speed. Moreover, the separation of motor 232 from the shaft 229 allows for better spatial management of the motor and the fan. The separation of motor 232 from the shaft 229 also permits reduction in the weight of a unit of the saddle air conditioner 100 due to the reduction in the number of poles. Noise may also be reduced due to isolating the motor 232 from the motor bracket 240 by the cushion ring 242.

The above embodiments are described in connection with the fan 94. Recall that the fan 94 may define an axis of rotation that is parallel to a horizontal flow of air drawn by the fan 94. In an alternate embodiment, the split air conditioner 10 may employ twin cross flow blower wheels.

Figure 19:
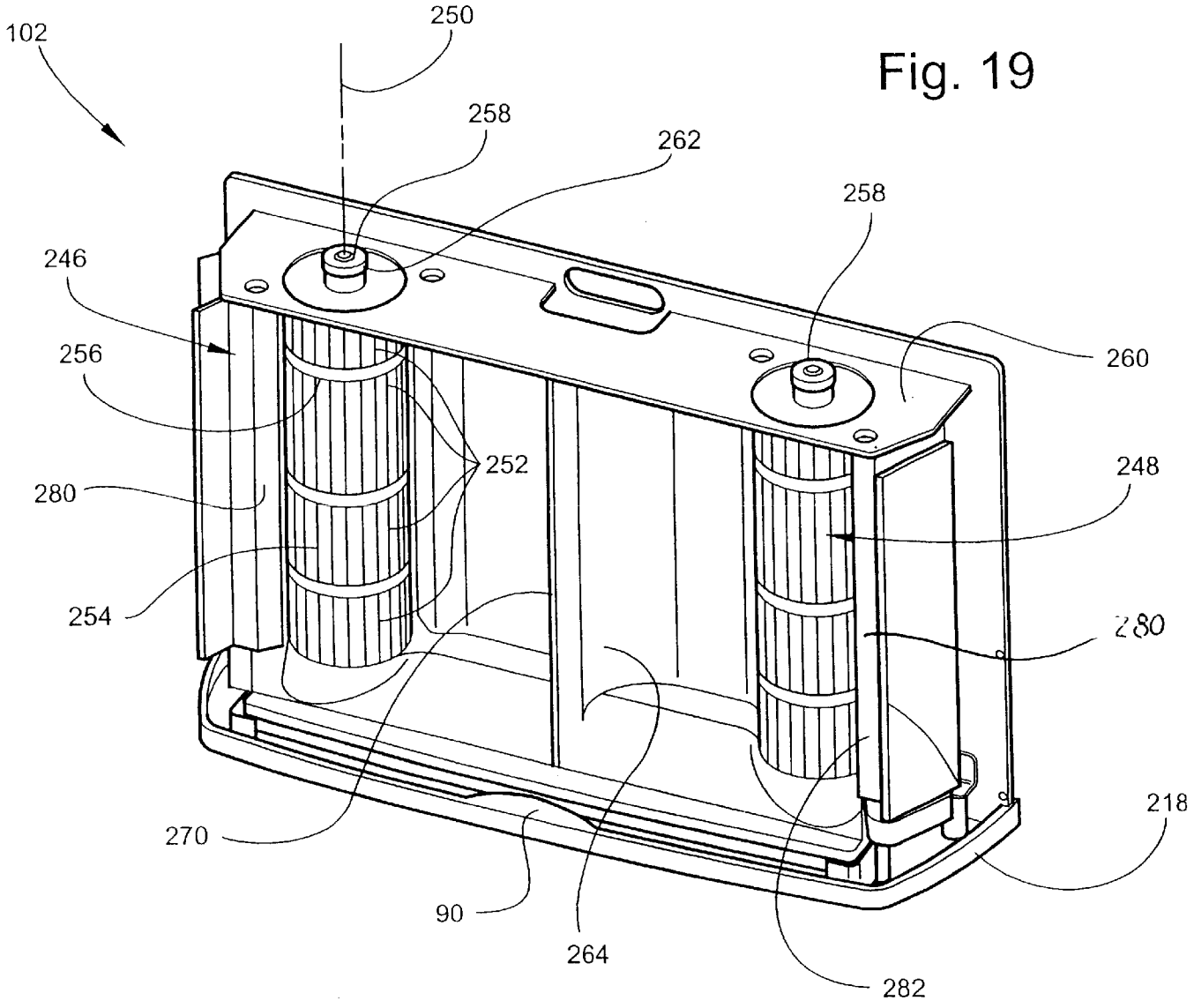
FIG. 19 illustrates a first blower wheel and a second blower wheel disposed in unit of a split air conditioner.
Figure 20:
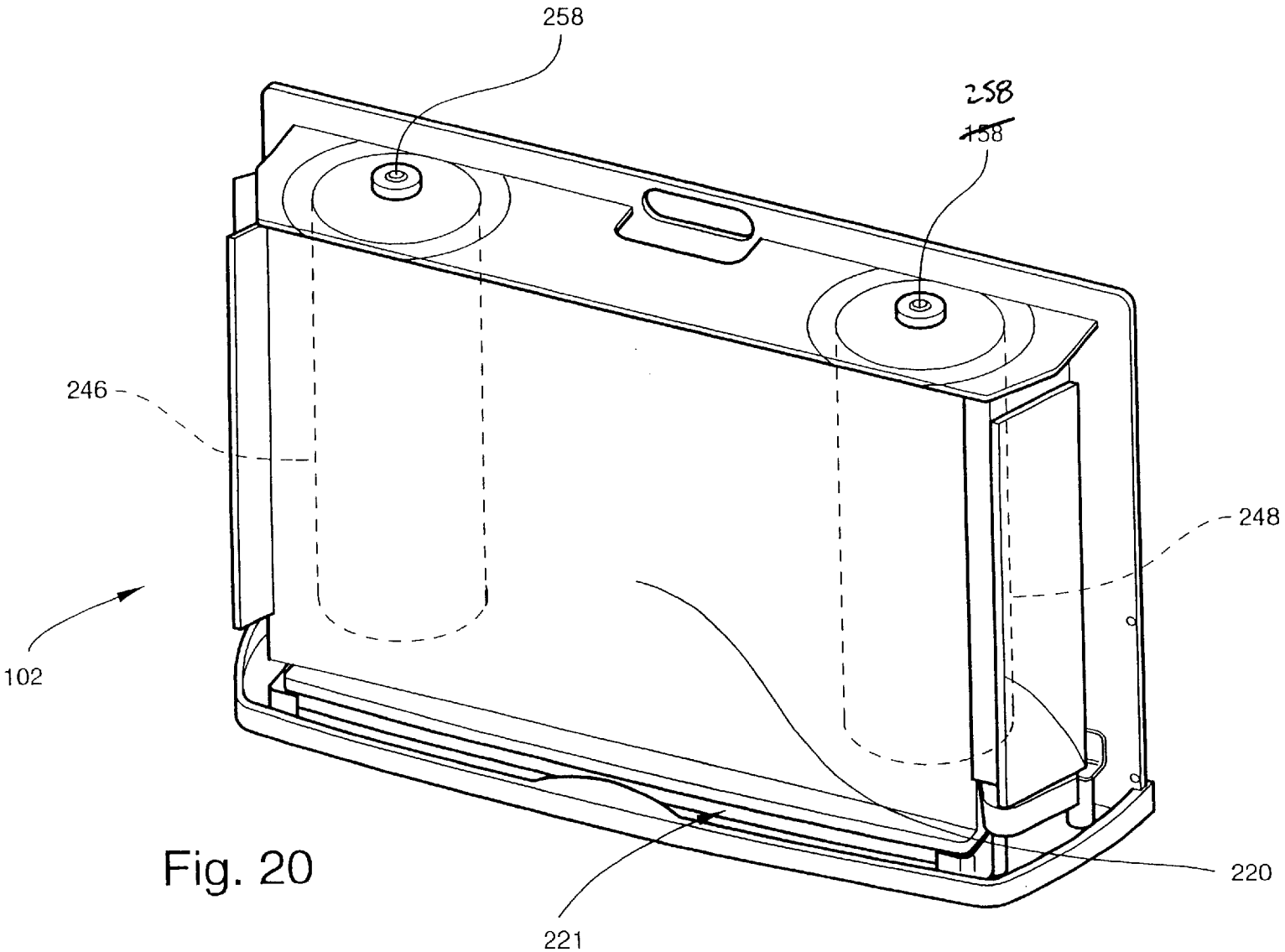
FIG. 20 illustrates the first blower wheel and the second blower wheel disposed behind an evaporator coil.

FIG. 19 illustrates a first blower wheel 246 and a second blower wheel 248 disposed in one unit of the split air conditioner 10. The unit illustrated in FIG. 19 is the local unit 102. FIG. 20 illustrates the first blower wheel 246 and the second blower wheel 248 disposed behind the evaporator coil 220. The first blower wheel 246 and the blower wheel 248 may work to draw air through the evaporator coil 220.

The second blower wheel 248 may be of similar structure as the first blower wheel 246. As seen in FIG. 19, the first blower wheel 246 may define the vertical axis 250 about which the first blower wheel 246 may rotate. Employing two vertically disposed blower wheels may permit the first blower wheel 246 and the second blower wheel 248 to define a length that is shorter than a single, horizontally disposed blower wheel, such as seen in U.S. Pat. No. 5,335,721. A shorter blower wheel is less likely to vibrate and generate noise from this vibration.

Disposed around the vertical axis 250 may be the blade sets 252. Each blade set 252 may include the blades 254 radially distributed about the vertical axis 250 and divided by the blade ring 256. In one embodiment, the first blower wheel 246 includes four blade sets 252. In another embodiment, the blades 254 are curved.

In this embodiment, the local unit 102 may further include the sleeve bearings 258, the upper blower support 260, the bearing supports 262, the shroud 264, the blower cutoffs 280. The sleeve bearings 258 may be any device that permits a blower wheel to rotate freely about the vertical axis 250. The sleeve bearing 258 may be coupled to a shaft (not shown) of the first blower wheel 246. The upper blower support 260 may be an L-shaped bracket secured to the back plate 223 at a location above the first blower wheel 246. The bearing supports 262 may be a disc having a ring extending inward to a raised dome, where the dome couples each sleeve bearing 258 to the upper blower support 260 through the ring. The dome may be adapted to permit a blower wheel to rotate below the raised dome.

Figure 21:
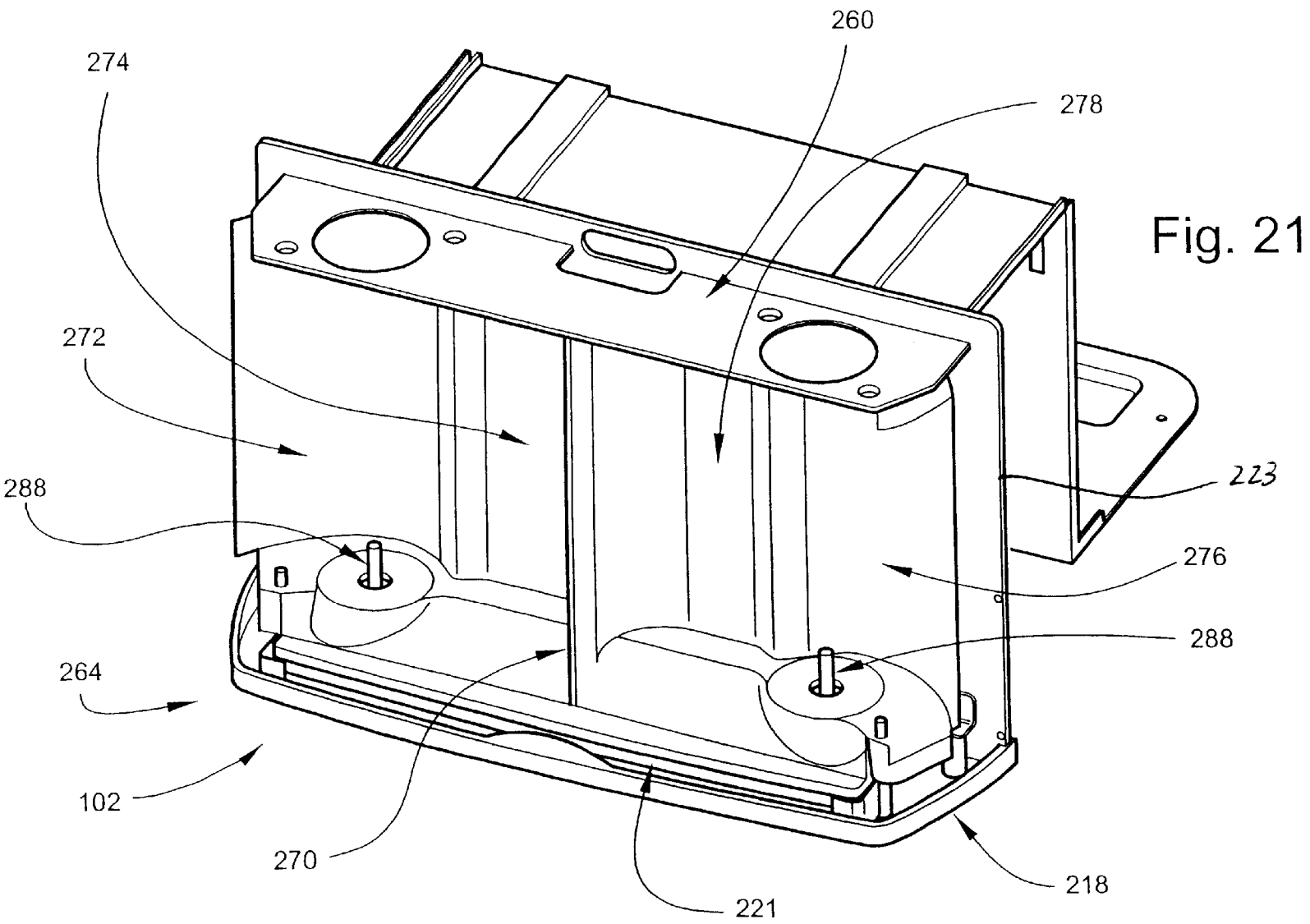
FIG. 21 is a perspective view of the local unit with the first blower wheel and the second blower wheel removed to reveal a shroud.

The shroud 264 may be a continuous formed sheet that aids in channeling air from the front grill 39 to the first louver 40 and the second louver 92. FIG. 21 is a perspective view of the local unit 102 with the first blower wheel 246 and the second blower wheel 248 removed to reveal the shroud 264. The shroud 264 may include the wall 270, the first curved portion 272, the first channel 274, the second curved portion 276, and the second channel 278.

The wall 270 may extend as part of the shroud 264 from a point adjacent to the evaporator coils 220 towards the back plate 223 at a midpoint of the evaporator coils 220. In this arrangement, the wall 270 may serve to evenly divide and channel an inlet measure of air between the first blower wheel 246 and the second blower wheel 248. The first curved portion 272 may be coupled between the wall 270 and the first channel 274. Moreover, the second curved portion 276 may be coupled between the wall 270 and the second channel 278.

An inlet measure of air that is guided towards the first blower wheel 246 may encounter the first curved portion 272. The shape of the first curved portion 272 may cause the measure of air to change directions towards the first blower wheel 246. In one embodiment, the first curved portion 272 defines a perimeter that is one quarter of a circle.

The first channel 274 may be disposed about the first blower wheel 246 from the first curved portion 272 to a location that is adjacent to the first louver 40 (FIG. 2). As the first blower wheel 246 rotates within the first channel 274, air may be moved from the first curved portion 272 to the first louver 40 as guided by the first channel 274. On reaching the first louver 40, the air may encounter the blower cutoff 280. The blower cutoff 280 may have a first edge that extends to a location that is adjacent to the first blower wheel 246 and a second edge that extends to a location that is adjacent to the first louver 40. This arrangement of the blower cutoff 246 may strip air from the first blower wheel 246 and guide the air towards the first louver 40. The second curved portion 276, the second channel 278, and the blower cutoff 282 may define a structure and arrangement that aids the second blower wheel 248 in moving a measure of air from the evaporator coil 220 to the second louver 92. The structure and arrangement of the second curved portion 276, the second channel 278, and the blower cutoff 282 may be similar to that of the first curved portion 272 and the first channel 274.

FIG. 22 is a perspective view of the local unit 102 with the shroud 264 removed to reveal the first motor 284 and the second motor 286. Each first motor 284 and 286 may be coupled to the wheel motor shafts 288 of FIG. 21. The first motor 284 and second motor 286 may be independently operated motors that work towards providing independent operations for each of the first blower wheel 246 and the second blower wheel 248.

As an alternative to the first motor 284 and the second motor 286, the first blower wheel 246 and the second blower wheel 248 may employ an indirect drive, pulley operated, fan speed reduction system similar to the fan motor system 230 of FIG. 18. FIG. 22A illustrates a blower wheel motor system 289. Each wheel motor shaft 288 may be coupled to a first pulley wheel 234. The pulley belts 238 may extend from each of the first pulley wheel 234 to one of two the second pulley wheels 236 mounted to the shaft 244 of the motor 232. The motor 232 may be disposed below the wall 270 (FIG. 21) of the shroud 264 to provide a balanced operation.

As has been shown in the embodiments of FIGS. 15, 18, and 19, the local unit is capable of being a stand alone unit. Thus, referring for example, to FIG. 15, a HEPA filter 222 may be substituted for the evaporator 220, and the local unit may be utilized as a stand alone air purifier. Thus, the local unit configuration facilitates the unit functioning as the basis for a saddle mount air conditioner, a split air conditioner, and an air purifier. In each case, the local unit mounts in the same vertical orientation.

Figure 23:
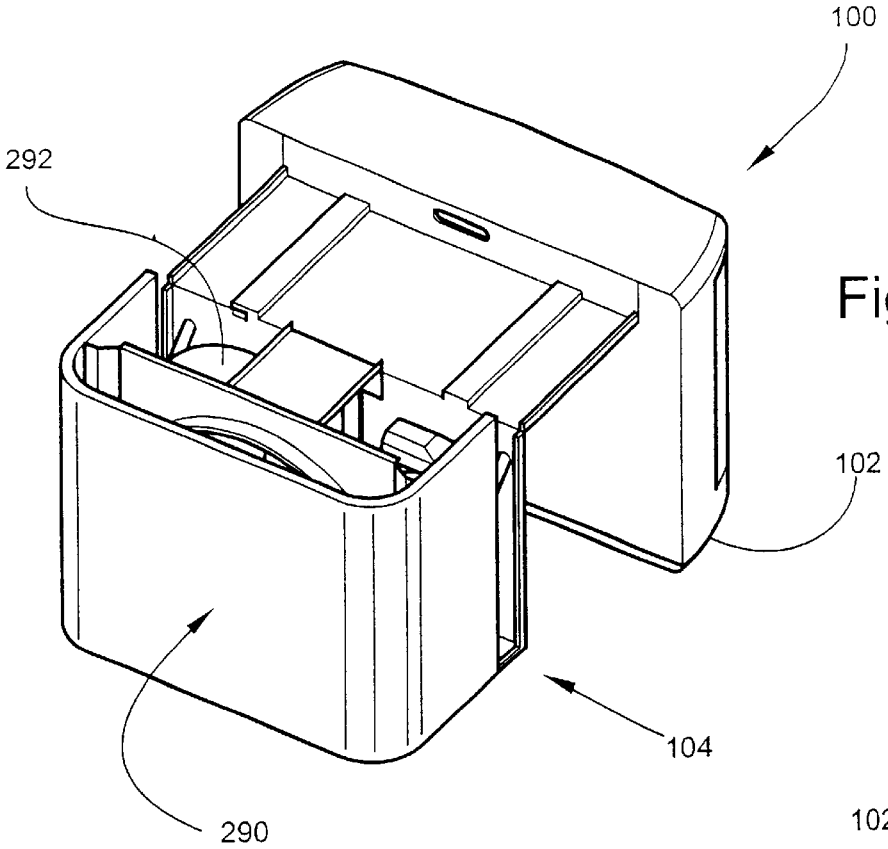
FIG. 23 is a perspective view of the saddle air conditioner with parts removed to reveal details of a remote unit.

FIG. 23 is a perspective view of the saddle air conditioner 100 with the parts removed to reveal details of a remote unit 104. As shown in the view of FIG. 23, the remote unit 104 may include a conventional condenser tubes 290. The condenser 290 may include set of heat exchanging pipes coupled at a first end to the suction line 52 (FIG. 2A) through the compressor 292 and at a second end to the expansion line 54 (FIG. 2A) through an expansion valve (not shown). The condenser 290 may be disposed about two radii to present a U-shaped configuration.

FIG. 24 is a detailed view of the remote unit 104 with the condenser tubes 290 removed. The remote unit 104 further may include the fan orifice 294 disposed about the condenser fan 296, the brace 297, and the condensate sump 298. In conventional split air conditioners, the condensate is discharged to the ground. However, this causes a major inconvenience and wastes a resource that may be used for other purposes. For example, by discharging the condensate 66 (FIG. 2A) from the condensate line 68 into the condensate sump 298, the condenser fan 296 may draw the condensate 66 up with the aid of a slinger ring (not shown) and splash the condensate 66 onto the coils of the condenser tubes 290. Here, the dispensed condensate 66 may draw heat away from the coils of the condenser tubes 290 through evaporation. This, in turn, increases the efficiency of the saddle air conditioner 100 by as much as seven percent and works to prevent blemishing of a building facade (e.g., wall 22) by water stains.

The remote unit 104 may further include the condensate removal pump 299 disposed within the remote unit 104. The condensate removal pump 299 may be used to remove the condensate 66 (FIG. 2A) from the pan 221 (FIG. 21). In one embodiment, the condensate removal pump 299 is a water pump. In another embodiment, the condensate removal pump 299 is an air assisted condensate pumping system. Locating the condensate removal pump 299 in the remote unit 104 works towards reducing the amount of indoor noise produced by the split air conditioner 10.

Figure 25:
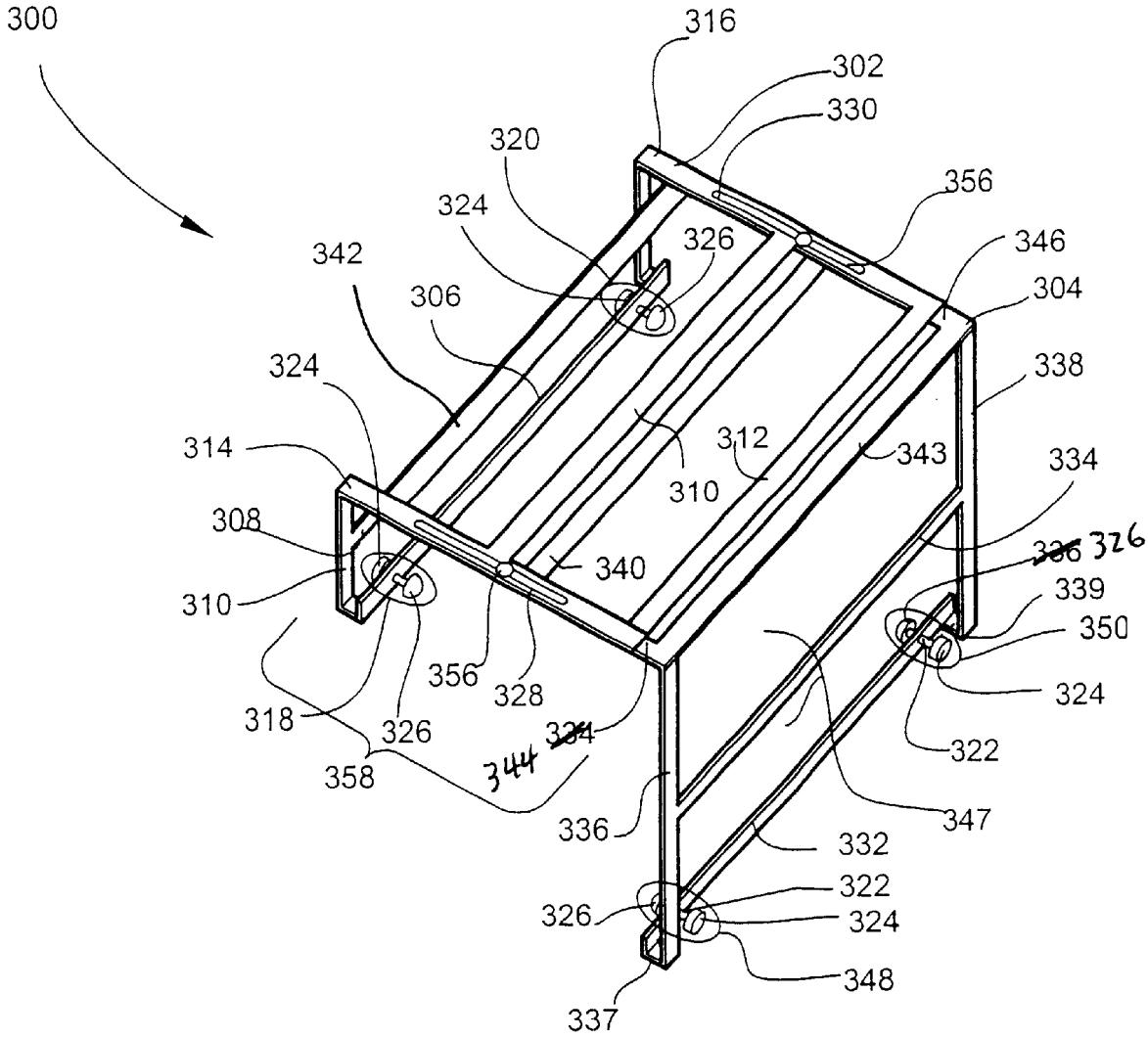
FIG. 25 illustrates an installation bracket of the invention.

FIG. 25 illustrates an installation bracket 300 of the invention. The installation bracket 300 may simplify installation of the saddle air conditioner 100 into the window 32 (FIG. 11). The installation of the saddle air conditioner 100 into the window 32 may be simplified by the installation bracket 300 in that the installation bracket 300 permits the saddle air conditioner 100 to be installed completely from the indoor area 28. A consumer need not reach out of the window 32 for installation or adjustment. Additionally, the installation bracket 300 may keep the remote unit 104 away from the wall 22. Keeping the remote unit 104 away from the wall 22 works to permit air to enter from the back of the remote unit 104 so as to minimize or eliminate the need to draw air into the remote unit 104 from the top of the remote unit 104.

The installation bracket 300 may include the local frame 302 and the remote frame 304. The local frame 302 may be coupled to the remote frame 304 as detailed below. Moreover, the local frame 302 may be used in relation to the local unit 102 and the remote frame 304 may be used in relation to the remote unit 104. Each of the local frame 302 and the remote frame 304 may be made from a light weight sheet metal, plastic, or a combination thereof.

The local frame 302 may include a brace 306, a first rib 308, a first leg 310, and a second leg 312. The brace 306 may extend between the first leg 310 and the second leg 312 at a lower end of the first leg 310 and the second leg 312. The first rib 308 may extend between the first leg 310 and the second leg 312 at a midpoint of the first leg 310 and the second leg 312 to retain the first leg 310 at a fixed distance from the second leg 312.

A top surface of the local frame 302 may include the second rib 310 and the local crossbar 312 disposed between a first bar 314 and a second bar 316. At a midpoint of the first bar 314 and the second bar 316, the second rib 310 may retain the first bar 314 at a fixed distance from the second bar 316. The first bar 314 may be coupled to the first leg 310 at an angle of ninety degrees and the second bar 316 may be coupled to the second leg 312 at an angle of ninety degrees. The local crossbar 312 may be disposed between the first bar 314 and the second bar 316 at a distal location from the first leg 310 and the second leg 312.

The local frame 302 further may include a first spacer 318 and a second spacer 320. Each of the first spacer 318 and the second spacer 320 may include a shaft 322 disposed between a knob 324 and a pad 326. The shaft 322 may include the external threads. The knob 324 may be a turning handle. The pad 326 may include rubber. To aid in assembling the local frame 302 into the remote frame 304, the first bar 314 may include a first slot 328 and the second bar 316 may include a second slot 330.

The remote frame 304 may include a brace 332, a first rib 334, a first leg 336, and a second leg 338. The first leg 336 and the second leg 338 each may have a first foot 337 and a second foot 339, respectively, extending ninety degrees from a lower portion towards the local frame 302. The brace 332 may extend between and ninety degrees up from the first foot 337 and the second foot 339. The first rib 334 may extend between the first leg 336 and the second leg 338 at a midpoint of the first leg 336 and the second leg 338 to retain the first leg 336 at a fixed distance from the second leg 338.

A top surface of the remote frame 304 may include a second rib 340, a remote crossbar 342, and a third rib 343 disposed between a first bar 344 and a second bar 346. At a midpoint of the first bar 344 and the second bar 346, the second rib 340 may retain the first bar 344 at a fixed distance from the second bar 346. The first bar 344 may be coupled to the first leg 336. Moreover, the second bar 346 may be coupled to the second leg 338. The remote crossbar 342 may be disposed between the first bar 344 and the second bar 346 at a distal location from the third rib 343.

The arrangements of the brace 332, the first rib 334, and the third rib 343 with respect to the first leg 336 and the second leg 338 define openings 347. The height of the brace 332 and the first rib 334 may be minimized to maximize the size of the openings 347. In one embodiment, the collective height of the openings 348 accounts for at least 90% of the overall distance the first foot 337 to the third rib 343.

The remote frame 304 further may include a first spacer 348 and a second spacer 350. Each of the first spacer 348 and the second spacer 350 may include the shaft 322 disposed between the knob 324 and the pad 326. To aid in assembling the remote frame 304 into the local frame 302, the first bar 344 may include a first slot 352 (not shown) and the second bar 346 may include a second slot 354 (not shown). The installation bracket 300 may further include a connector such as the bolt and wing nut assembly 356.

To assemble the local frame 302 and the remote frame 304 together, the first slot 328 may be aligned with the first slot 352 to form a first slot group and the second slot 330 may be aligned with the second slot 354 to form a second slot group. At least one bolt and wing nut assembly 356 may be loosely fit into each slot group. When assembled, an upper surface of the installation bracket 300 may define the platform 358.

Figure 26:
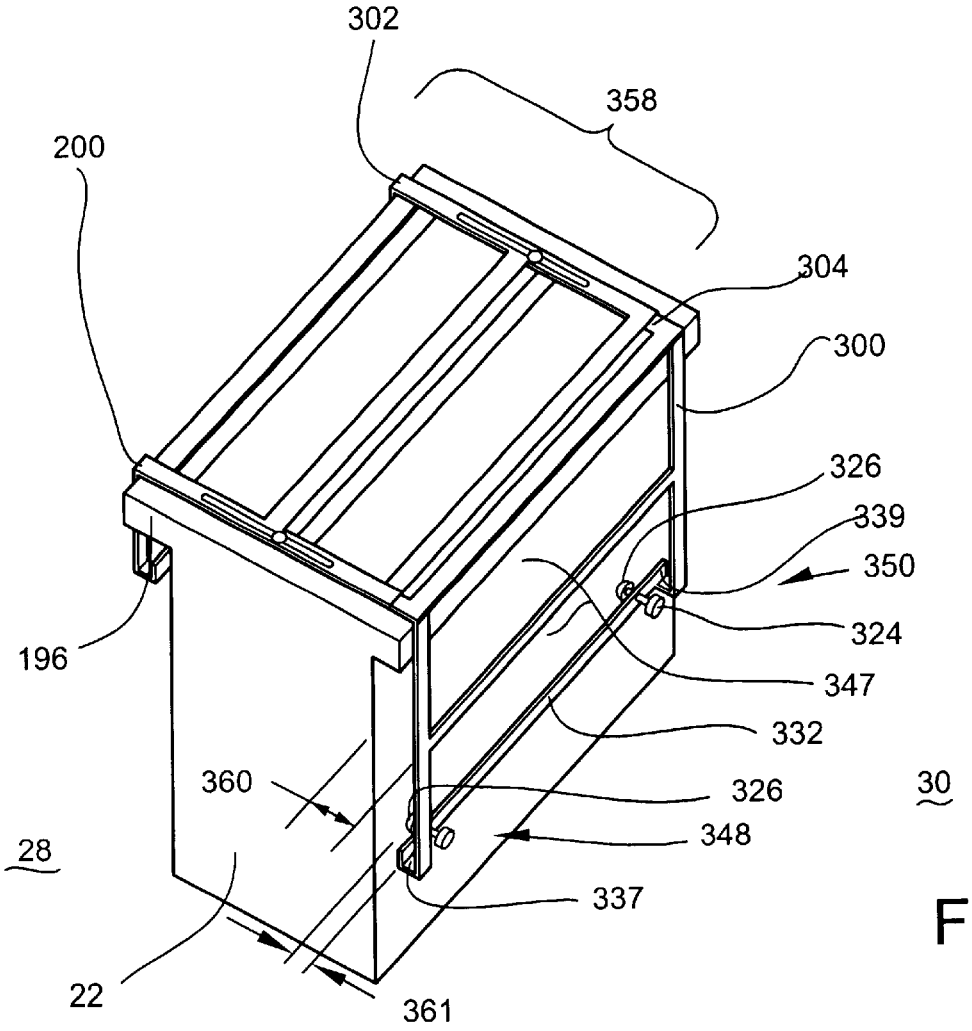
FIG. 26 illustrates an installation bracket disposed over a bottom rail of a window sill (FIG. 11)

FIG. 26 illustrates the installation bracket 300 disposed over the bottom rail 196 (FIG. 11) of the wall 22. In this arrangement, the platform 358 may span a width of the bottom rail 196. With the installation bracket 300 disposed over the bottom rail 196, the local frame 302 and the remote frame 304 may be pushed towards one another and each bolt and wing nut assembly 356 tightened. To maintain the remote frame 304 at distance 360 from the wall 22, each knob 324 of first spacer 348 and second spacer 350 may be turned until each pad 326 engages an exterior surface of the wall 22. The first spacer 318 and the second spacer 320 may similarly be tightened.

The extent of space between a plane formed by the first leg 336 and the second leg 338 and the wall 22 may define distance 360. The extent of space between the brace 332 and the wall 22 may define distance 361. The distance 361 is less than the distance 360. In one embodiment, the distance between the brace 332 and the wall 22 (distance 361) is at least fifty to seventy percent of the distance between the first leg 336 and the wall 22 (distance 360).

As noted above, the structural arrangement of the remote frame 304 may include the first foot 337 and the second foot 339, each extending at ninety degrees from an associated leg towards the local frame 302. The first foot 337 and the second foot 339 may serve to bring the brace 332 to a position that is adjacent to the wall 22 at distance 361.

Bringing the brace 332 to a position that is adjacent to the wall 22 provides a number of advantages. For example, bringing the brace 332 to a position that is adjacent to the wall 22 minimizes the number of times knob 324 must be turned for the pads 326 to engage the exterior surface of the wall 22. This reduces the time it takes to position the installation bracket 300. As another example, bringing the brace 332 to a position that is adjacent to the wall 22 moves the forces experienced at the pads 326 closer to the brace 332. This permits using the smaller and cheaper shafts 322 while providing a desired stability.

Figure 27:
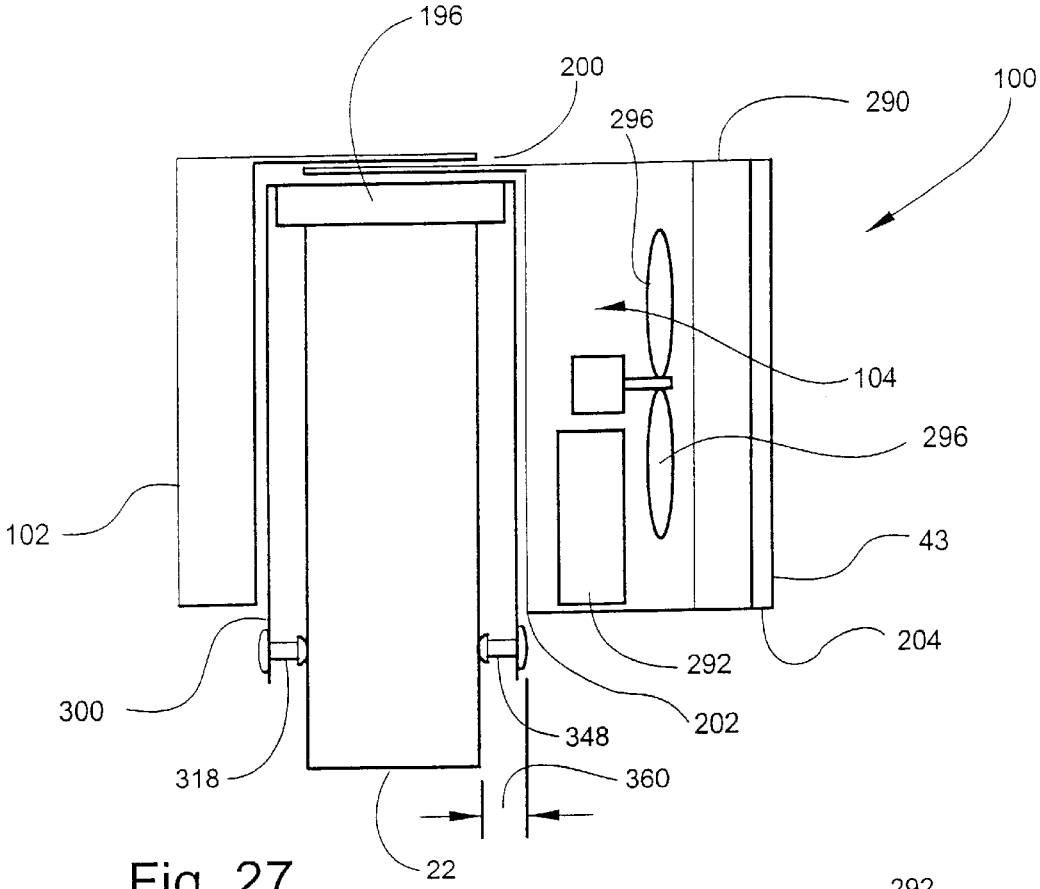
FIG. 27 illustrates the saddle air conditioner disposed over the installation frame.
Figure 28:
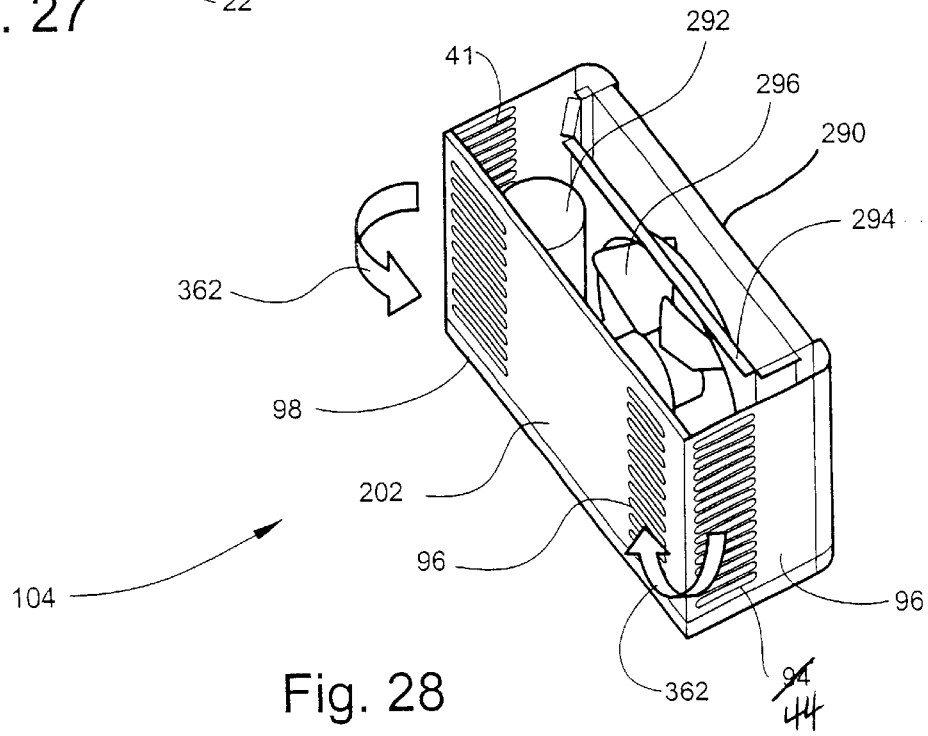
FIG. 28 illustrates an air path with respect to the remote unit.

FIG. 27 illustrates the saddle air conditioner 100 disposed over the installation frame 300. The remote unit 104 of the saddle air conditioner 100 may be compact in width. For example, in one embodiment, the distance between the wall 22 and a distal part of front grill 43 is less than or equal to 9.75 inches. FIG. 28 illustrates the air path 362 with respect to the remote unit 104.

As seen in FIG. 27, the back 202 (FIG. 14) of the remote unit 104 may be retained at the distance 360 from the wall 22 by the installation bracket 300. The retention of the remote unit 104 from the wall 22 at the distance 360 may permit air to travel along air path 362 (FIG. 28) to the back of the remote unit 104 and enter the first back grill 96 and the second back grill 98. The entry of air into the first back grill 96 and the second back grill 98 may be in addition to air entering the first louver 41 and the second louver 44. Drawing air into the remote unit 104 from the back 202 and the sides of the remote unit 104 works towards eliminating the need to draw air from the top of the remote unit 104. In turn, not drawing air from the top of the remote unit 104 works towards preventing the noise from the condenser fan 296 from propagating to the indoor area 28.

The exemplary embodiments described herein are provided merely to illustrate the principles of the invention and should not be construed as limiting the scope of the subject matter of the terms of the claimed invention. The specification and drawings are, accordingly, to be regarded in an illustrative rather than a restrictive sense. Moreover, the principles of the invention may be applied to achieve the advantages described herein and to achieve other advantages or to satisfy other objectives, as well.

What is claimed is:

1. A local unit of an air treatment appliance comprising:

an air moving device that can be configured as part of a window air conditioner, a split air conditioner, or an air purifier, having a first blower wheel and a second blower wheel, wherein each of the first blower wheel and the second blower wheel define a vertical axis of rotation.

2. An air treatment appliance having a local unit that can be configured as part of a window air conditioner, a split air conditioner, or an air purifier, and, when the air treatment appliance is configured as a split air conditioner comprising:

a local unit having an air moving device including a first blower wheel and a second blower wheel, wherein each of the first blower wheel and the second blower wheel defines a vertical axis of rotation;

a remote unit; and a supply system disposed between the local unit and the remote unit.

3. The split air conditioner of claim 2, further comprising:

a shroud disposed about the first blower wheel and the second blower wheel.

4. The split air conditioner of claim 3, wherein the shroud is a continuous formed sheet having a wall that divides the first blower wheel from the second blower wheel.

5. The split air conditioner of claim 4, wherein the shroud further includes a first curved portion coupled between the wall and a first channel and includes a second curved portion coupled between the wall and a second channel.

6. A local unit of an air treatment appliance comprising:

an air moving device for a window air conditioner configured as a saddle air conditioner, and having a fan motor system comprising:

a fan having a shaft;

a first pulley wheel coupled to the shaft of the fan;

a motor having a shaft, wherein the motor includes a plurality of poles and wherein the number of poles is less than six;

a second pulley wheel coupled to the shaft of the motor; and a pulley belt disposed between the first pulley wheel and the second pulley wheel.

7. The fan motor system of claim 6, wherein the ratio of a diameter of the first pulley wheel to a diameter of the second pulley wheel is in the range of about 3:1 to 3:2.

* * * * *